US007557790B2

(12) United States Patent
Jeon et al.

(10) Patent No.: US 7,557,790 B2
(45) Date of Patent: Jul. 7, 2009

(54) BUS INTERFACE TECHNOLOGY

(75) Inventors: Yong Weon Jeon, Suweon (KR); Chang Sig Kang, Yongin (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 295 days.

(21) Appl. No.: 10/385,431

(22) Filed: Mar. 12, 2003

(65) Prior Publication Data

US 2004/0178976 A1 Sep. 16, 2004

(51) Int. Cl.
*G09G 3/36* (2006.01)

(52) U.S. Cl. ..... 345/98; 345/87; 345/92; 345/100; 345/104

(58) Field of Classification Search ..... 345/87–104, 345/204–215, 690–699; 375/219, 222, 257; 326/21, 90; 327/77
See application file for complete search history.

(56) References Cited

U.S. PATENT DOCUMENTS 4,280,221 A * 7/1981 Chun et al. ..... 375/288
5,315,175 A * 5/1994 Langner ..... 326/21
5,374,861 A 12/1994 Kubista
5,499,269 A * 3/1996 Yoshino ..... 375/257
5,589,813 A 12/1996 Nielsen
5,892,717 A 4/1999 Malarsie
5,987,543 A * 11/1999 Smith ..... 710/70
6,034,551 A 3/2000 Bridgewater, Jr.
6,147,672 A * 11/2000 Shimamoto ..... 345/589
6,229,513 B1 * 5/2001 Nakano et al. ..... 345/99
6,317,465 B1 * 11/2001 Akamatsu et al. ..... 375/257
6,344,843 B1 * 2/2002 Koyama et al. ..... 345/100
6,480,180 B1 * 11/2002 Moon ..... 345/98
6,487,614 B2 * 11/2002 Nobutani et al. ..... 710/20
6,492,984 B2 * 12/2002 Martin ..... 345/213
6,603,465 B1 * 8/2003 Hashimoto et al. ..... 345/204
6,657,622 B2 * 12/2003 Park ..... 345/205

(Continued)

FOREIGN PATENT DOCUMENTS

JP 5037330 2/1993

(Continued)

OTHER PUBLICATIONS

William J. Dally and John W. Poulton, "Chapter 7, Signaling Conventions" In *Digital Systems Engineering*, pp. 304-319. Cambridge: Cambridge University Press, 1998.

(Continued)

*Primary Examiner*—Vijay Shankar
(74) *Attorney, Agent, or Firm*—Harness, Dickey & Pierce, P.L.C.

(57) ABSTRACT

The invention, in part, provides a method of (and corresponding apparatus for) receiving (and similarly transmitting) data signals over data lines. Such a method of receiving comprises: organizing said data lines into groups, each group having N input data signals and M reference signals, wherein N is a non-zero, positive integer; associating M reference signals on M reference lines with each group of N input data lines, wherein M is a non-zero, positive integer and N>M; and receiving data on said data lines and reference signals on said reference lines; and determining, for each group, data values on said data lines according to differences between signal parameters on said N data lines and signal parameters on said M reference lines, respectively.

30 Claims, 25 Drawing Sheets

U.S. PATENT DOCUMENTS

| | | | | |
|---|---|---|---|---|
| 6,664,816 | B1 * | 12/2003 | Nguyen et al. | 327/74 |
| 6,839,055 | B1 * | 1/2005 | Nguyen | 345/204 |
| 6,898,201 | B1 * | 5/2005 | James et al. | 370/400 |
| 6,940,496 | B1 * | 9/2005 | Kim | 345/204 |
| 2002/0005841 | A1 * | 1/2002 | Jung et al. | 345/204 |

FOREIGN PATENT DOCUMENTS

| | | | |
|---|---|---|---|
| JP | 6149430 | | 5/1994 |
| JP | 07-038139 | * | 2/1995 |
| KR | P1998-018150 | | 6/1998 |
| KR | 101999002552 | | 1/1999 |
| KR | 1020000027735 | | 5/2000 |
| KR | 1020010004649 | | 1/2001 |

OTHER PUBLICATIONS

Chinese Office Action (dated Jan. 4, 2008) and its English language translation for counterpart Chinese Patent Application No. 2003-101188433 is provided for the purposes of certification under 37 C.F.R. §§ 1.97(e).

* cited by examiner

BUS INTERFACE TECHNOLOGY

BACKGROUND OF THE INVENTION

Pixels on a flat panel display generally correspond to the intersection of source lines (typically corresponding to columns of a matrix) and gate lines (typically corresponding to rows of the matrix). As display formats tend to increase in size, the rate of the data that must be transferred to the display must be increased accordingly. For example, using the same clock frequency, an ultra extended graphics array (UXGA) (having 1600 columns by 1200 rows, i.e., 1600×1200) requires four times the rate of data transfer as the super video graphics array (SVGA) format (800×600). In practical terms, this could mean that the UXGA could require four times as many data lines in its interface bus as does the SVGA. But if the number of data lines for each interface bus is to be kept the same, then the UXGA interface bus has to operate at a frequency four times greater than the interface bus of the SVGA.

Another tendency in the display art is for the bit length of the gray scale to increase. Formerly, 18-bit gray scale schemes were common. Twenty-four bit gray scale schemes seem likely to replace the 18-bit schemes. And it is likely that increasingly lengthier bit schemes will be adopted. The 24-bit scheme uses 8-bits for the red, blue and green colors. The 18-bit scheme uses 6-bits for each color, i.e., R, G and B. The change in gray-scale bit length from 18 to 24 represents an increase in data rate by approximately 33%.

FIG. 1 depicts a schematic block diagram of a flat panel display system 100 according to the Background Art. This system 100 has a graphic controller 102 that includes a low voltage differential signal (LVDS) transmitter (TX) 104. The system 100 further has a flat panel display device, e.g., a liquid crystal display (LCD) device, 106 that includes: a timing controller 108; source driver circuits 110; gate driver circuits 112; and a thin film transistor (TFT) LCD panel 114. The graphic controller 102 provides display signals to the timing controller 108 via the LVDS TX 104. The timing controller 108 provides corresponding data signals to the source driver circuits 110 and the gate driver circuits 112.

A first type of technology for implementing the interface bus of the LCD device 106 is based on transistor-transistor logic (TTL). FIG. 2A depicts a simple schematic block diagram of a TTL display system 200 according to the Background Art. The system 200 includes: a timing controller (T_CON) 202 that itself includes a transmitter 204; a transmission line 206; and a source driver 208 that itself includes a receiver 210. FIG. 2A has been simplified by depicting only one transmitter 204, one transmission line 206 and one receiver 210; in actuality a plurality of each would be present. FIG. 2B depicts a more detailed schematic block diagram of the TTL display system 200. FIG. 2B includes an LVDS transmitter 212 and an LCD device 214. The LCD device 214 includes a timing controller 216 that itself includes an LVDS receiver (RX) 218, a phase-locked-loop (PLL) 219 and a TTL TX 220. The LCD device 214 further includes a plurality of source drivers $\mathbf{208}_1$, $\mathbf{208}_2$ . . . $\mathbf{208}_8$.

FIG. 2B assumes a 6-bit gray scale scheme. As such, each pixel's worth of data received by the LVDS TX 212 represents a total of 18-bits, i.e., 6bits for each of the R, G and B colors. Basic TEL technology can operate at a clock speed of up to approximately 40 MHz. This clock speed is sufficient for the SVGA format (800×600), but is insufficient for the Extended Graphics Array (XGA) format (1024×768). The Background Art adapted the TEL technology to the higher XGA-level resolution by using frequency division. In other words, the timing controller 216 of FIG. 2B receives display data at a rate of 65 MHz via the LVDS receiver 218, which transfers it to the TEL transmitter 220. The TEL transmitter 220 provides the data to the respective source drivers 208 via two transmission lines, 206A and 206B, connected to each of the source drivers 208. Each of the transmission lines 206A and 206B operate at 32.5 MHz, i.e., half of the input data rate of 65 MHz.

But there are problems with this higher speed TTL arrangement. First, the number of data lines is doubled where, as in FIG. 2B, the frequency is halved. This increases the number of timing controller output pins and column driver input pins, which increases the surface area of the printed circuit board (PCB), increases cost and makes it much more difficult to achieve a compact design.

In addition, as the density of the interconnections on the PCB increases, such wiring is more prone to timing errors due to interference between the signal lines. FIGS. 2C and 2D depict the electric field and magnetic field radiation patterns from a TTL transmission line 206, respectively. In addition, each of the transmission lines 206 itself is easily affected by external noise. To reduce the noise contributed by the transmission lines 206, filters (not depicted) can be inserted into the transmission lines 206, but this further increases the surface area of the PCB that is consumed and further reduces the timing margin.

To solve some of the problems of a TTL-based bus interface, a reduced swing differential signaling (RSDS) bus interface was adopted by the Background Art. FIG. 3A depicts a simplified schematic block diagram of an RSDS bus interface system 300. The system 300 includes a transmission controller 302 (that includes its own transmitter 304), paired transmission lines 306A and 306B, a terminating resistor 311 and a source driver 308 (that includes its own receiver 310).

FIG. 3B is a more detailed version of the RSDS interface bus of FIG. 3A. In particular, FIG. 3B includes an LVDS transmitter (TX) 312 that provides display data to an LCD device 314. The LCD device 314 includes a timing controller 302 and source drivers 322. The timing controller 302 includes an LVDS receiver (RX) 318 and an RSDS TX 320.

As in FIG. 2B, a 6-bit gray scale scheme is assumed for FIG. 3B. RGB data totaling 18-bits per pixel is supplied to the LVDS transmitter 312 at 65 MHz. This data is transferred from the LVDS transmitter 312 to the LVDS receiver 318, which transfers the data then to the RSDS transmitter 320. Unlike the TTL-based technology of FIG. 2B, the RSDS-based technology of FIG. 3B can provide data from the RSDS transmitter 320 to each of the source drivers 322 at 65 MHz using 9 pairs of lines 306A, 306B. The system 300 conforms to the XGA mode, so 1024 pixel columns must be accommodated. Using RGB technology, each column is supplied with three color values R, G and B. In the example of FIG. 3B, eight source drivers 322 have been provided. As a result, each source driver 322 drives 384 columns or channels (1024×3/8).

The RSDS bus interface is based upon the concept of a current loop. A signal corresponding to a voltage difference across the terminating resistor 311 is used to convey whether the corresponding logical level is one or zero. The current flowing in each of transmission lines 306A and 306B is correspondingly less than in the transmission line 206 of FIG. 2A. Consequently, the RSDS bus interface produces a lower level of electromagnetic interference (EMI). FIGS. 3D and 3E depict the electric field and the magnetic field, respectively, associated with the transmission line pair 306A and 306B of the RSDS interface bus.

FIG. 3D depicts the sensing circuitry of FIG. 3A in more detail. In FIG. 3D, the terminating resistor 311 is represented as a series connection of two resistance values $R_{zo}$, equaling a total resistance of 2 $R_{zo}$. The receiver 310 in FIG. 3D is a comparator whose non-inverting input is connected ahead of the terminating resistor 311 (i.e., to transmission line 306A) and whose inverting input is connected after the terminating resistor 311 (i.e., to transmission line 306B). It should be noted that the terminating resistor 311 is external to the source driver 308. Stated differently, the RSDS bus interface is a current sourcing and current sensing scheme.

In the RSDS technique, the amplitude of a signal on the transmission lines 306A and 306B is reduced to 0.2 volts, which is much less than the typical TTL amplitude of 3.3 volts. Again, this is because the relative difference between the voltage levels on transmission lines 306A and 306B conveys the information content in the RSDS scheme. The RSDS paired transmission line arrangement produces less EMI than the single transmission line of the TTL arrangement. Also, the much smaller signal level used in the RSDS scheme results in a data bus having a smaller width than the TTL scheme, which leads to a reduction in the amount of the PCB surface area that is consumed.

But a disadvantage of the RSDS scheme is that each datum requires a pair of transmission lines 306A and 306B, which significantly increases the consumption of PCB surface area. Also, the pairs of transmission lines 306A and 306B requires the presence of external terminating resistors 311, which also increases the consumption of PCB surface area. Lastly, the RSDS technique is limited to a maximum clock speed of about 100 MHz. This precludes the RSDS technique from being used with a higher resolution display format that necessarily requires a faster data rate.

Because of the limitations in the RSDS bus interface, the Background Art adopted the Whisper Bus type of bus interface. FIG. 4A depicts a simplified schematic block diagram of the Whisper Bus system 400 according to the Background Art. The system 400 includes a timing controller 402 (which has a transmitter 404), a transmission line 406 and a source driver 408 (which has a receiver 410).

FIG. 4B depicts the Background Art Whisper Bus interface system of FIG. 4A in more detail as including an LVDS transmitter 412 and an LCD device 414. The LCD device 414 includes a timing controller 416 and source drivers 422. The timing controller 416 includes an LVDS receiver 418 and a whisper transmitter 420. The transmitter 412 receives 18 bits of RGB display data per pixel and provides that data to the timing controller 416 via the receiver 418 at a data rate of 65 MHz. The receiver 418 transfers the data to the whisper transmitter 420 at a rate of 65 MHz. The whisper transmitter 420 then provides the display data to the source drivers 422 at a rate of 73.125 MHz.

Like the TTL arrangements of FIGS. 2A and 2B, the Whisper Bus arrangement of FIGS. 4A and 4B uses only one transmission line per datum, which contrasts with the two transmission lines per datum used in the RSDS arrangement of FIGS. 3A and 3B. Unlike the TTL arrangement of FIGS. 2A and 2B, the Whisper Bus arrangement of FIGS. 4A and 4B reduces the current on the transmission line 406 from the 2 mA level of the TTL technology down to 300μA. Consequently, the Whisper Bus technology produces low amounts of EMI and consumes small amounts of power. Plus, in contrast to the RSDS technology, the Whisper Bus arrangement uses half the number of transmission lines. In other words, where the RSDS technology requires 2N transmission lines, only N data transmission lines are required for the Whisper Bus technology.

A further difference between the Whisper Bus technology and the RSDS technology concerns the external terminating resistor of the RSDS technology. Again, the terminating resistor 311 is outside the integrated circuit of the receiver 310. FIG. 4C shows that the receiver 410 is implemented by a comparator (as the receiver 410) whose inverting input is connected to the transmission line 406 via a serially-connected terminating resistor 425 that is internal to the integrated circuit of the source driver 408. The terminating resistor 425 can be an active resistance formed of transistors. The non-inverting input of the comparator 410 is connected to a reference voltage source 430. In addition, a feedback resistance 420 is connected between the output of the comparator 410 and the inverting input.

The Whisper Bus technology achieves high data rates, a reduced bus width and significantly reduced current levels, in contrast to the RSDS technology. But, the single transmission line arrangement of the Whisper Bus technology remains quite vulnerable to external noise.

SUMMARY OF THE INVENTION

The invention, in part, provides a method of (and corresponding apparatus for) receiving (and similarly transmitting) data signals over data lines. Such a method of receiving comprises: organizing said data lines into groups, each group having N input data signals and M reference signals, wherein N is a non-zero, positive integer; associating M reference signals on M reference lines with each group of N input data lines, wherein M is a non-zero, positive integer and N>M; and receiving data on said data lines and reference signals on said reference lines; and determining, for each group, data values on said data lines according to differences between signal parameters on said N data lines and signal parameters on said M reference lines, respectively.

Additional features and advantages of the invention will be more fully apparent from the following detailed description of the preferred embodiments, the appended claims and the accompanying drawings.

BRIEF DESCRIPTION OF THE DRAWINGS

The accompanying drawings are: intended to depict example embodiments of the invention and should not be interpreted to limit the scope thereof; and not to be considered as drawn to scale unless explicitly noted.

DETAILED DESCRIPTION OF PREFERRED EMBODIMENTS

Figure 1:
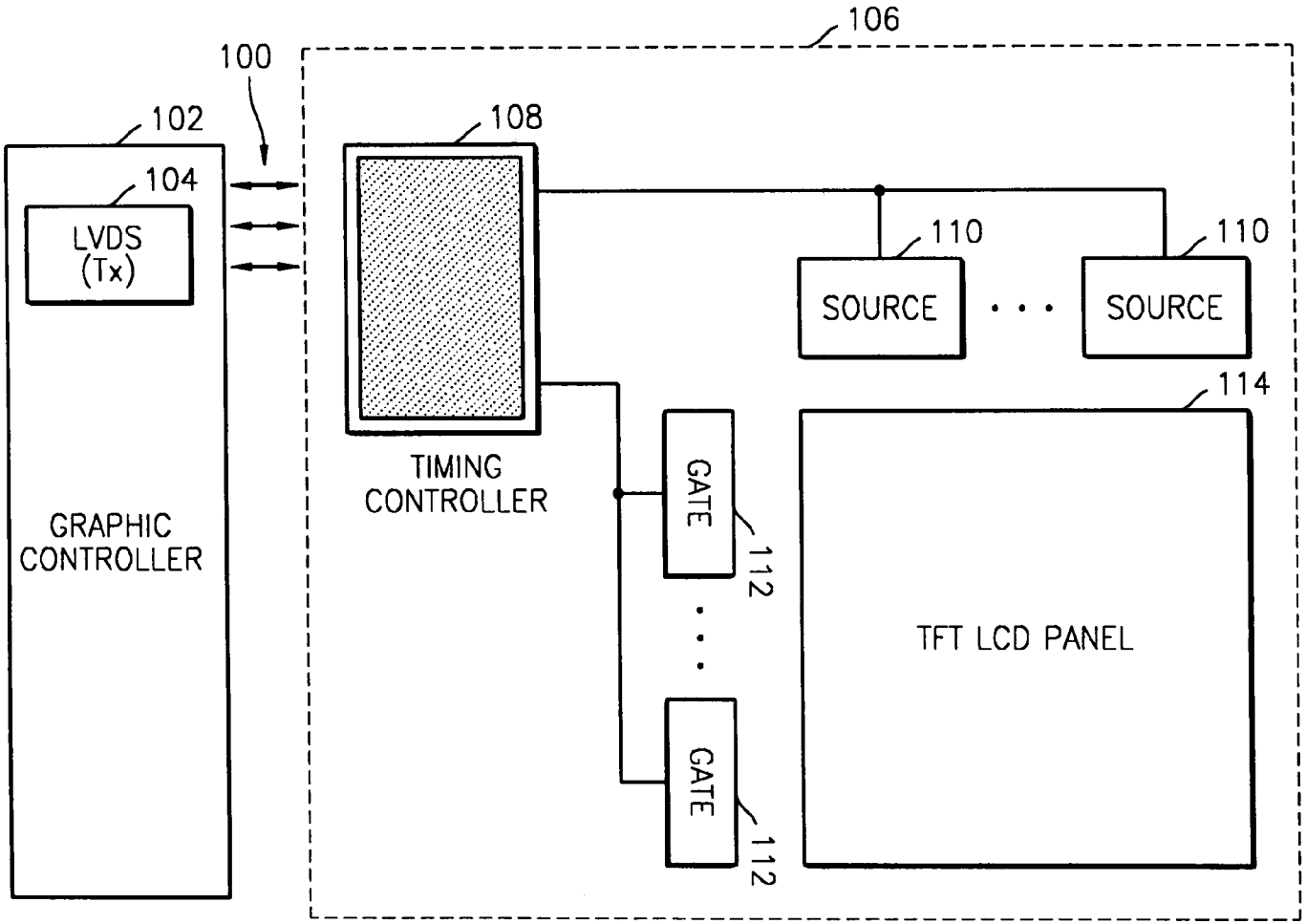
FIG. 1 (BACKGROUND ART)
FIG. 1 depicts a schematic block diagram of a flat panel display system 100 according to the Background Art.
Figure 2A:
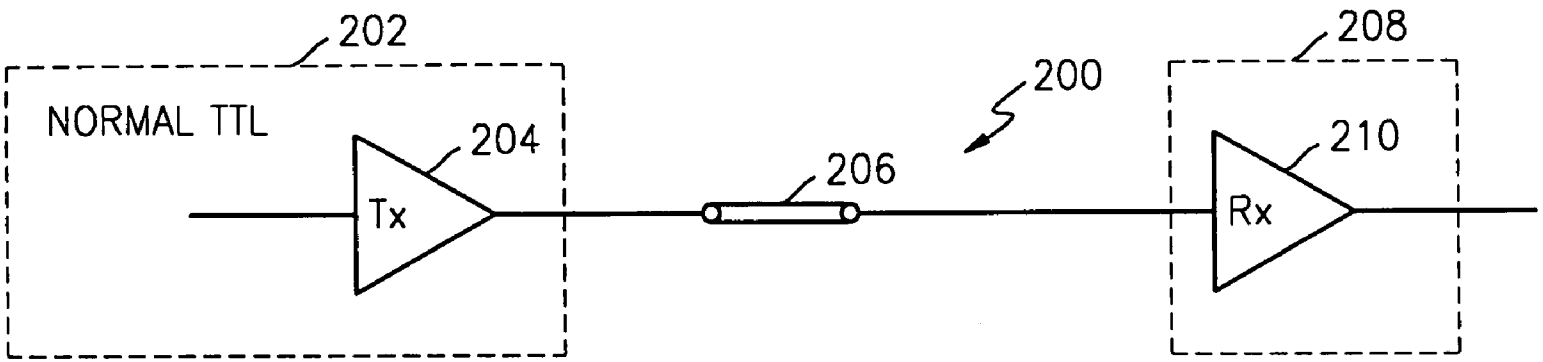
FIG. 2A (BACKGROUND ART)
FIG. 2A depicts a simple schematic block diagram of a TTL display system 200 according to the Background Art.
Figure 2B:
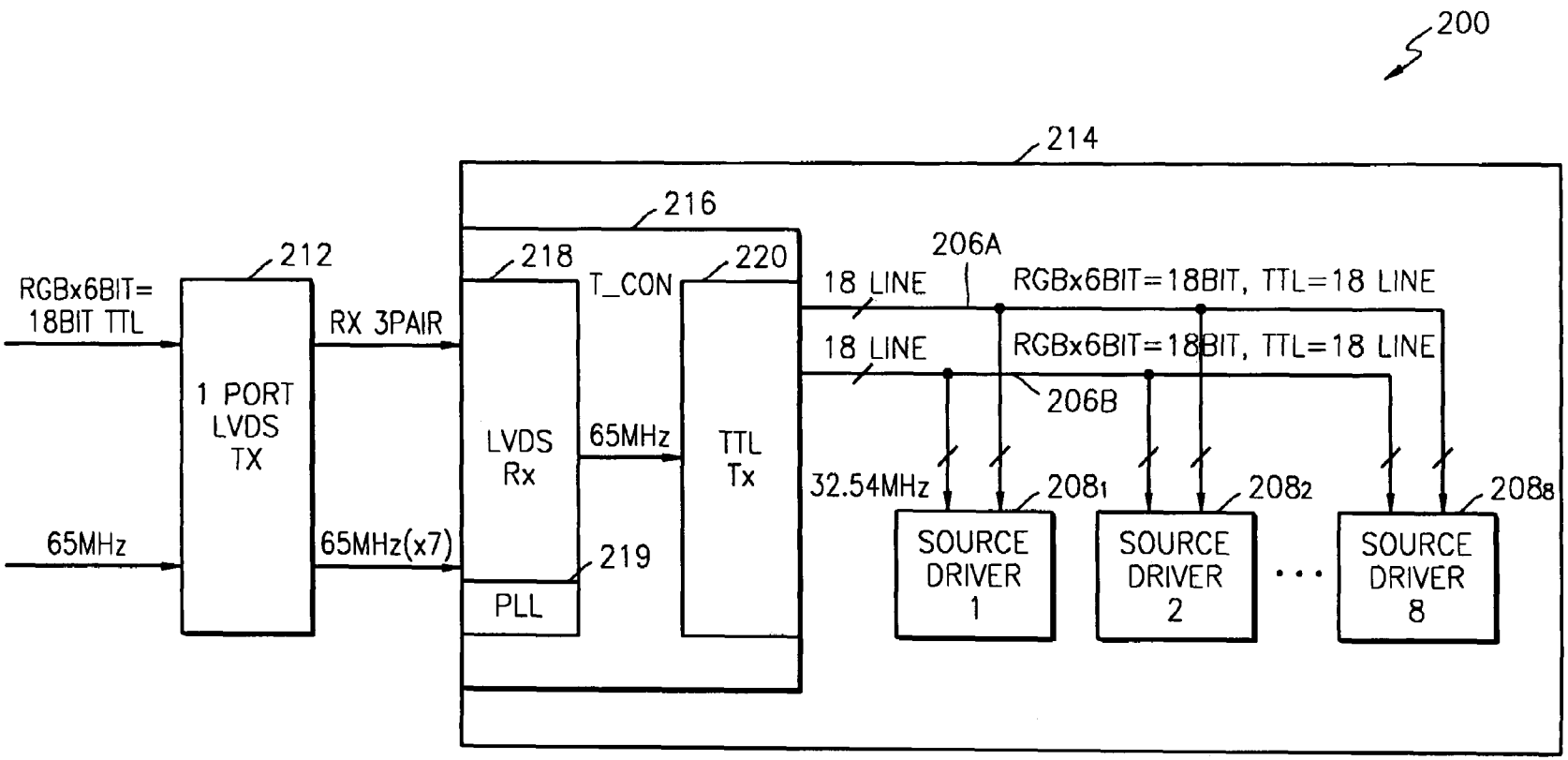
FIG. 2B (BACKGROUND ART)
FIG. 2B depicts a more detailed version of the TTL display system of FIG. 2A.
Figure 2C:
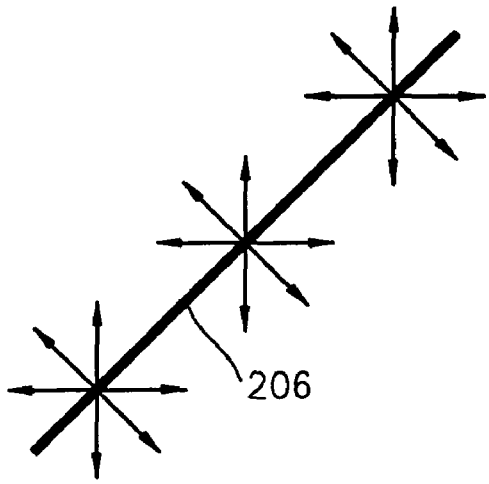
FIG. 2C (BACKGROUND ART)
FIGS. 2C and 2D depict the electric field and magnetic field radiation patterns, respectively, from a TTL transmission line 206 according to the Background Art.
Figure 2D:
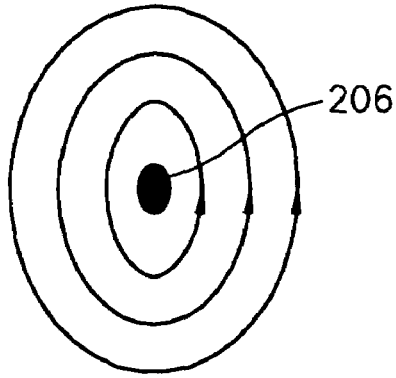
FIG. 2D (BACKGROUND ART)
Figure 3A:
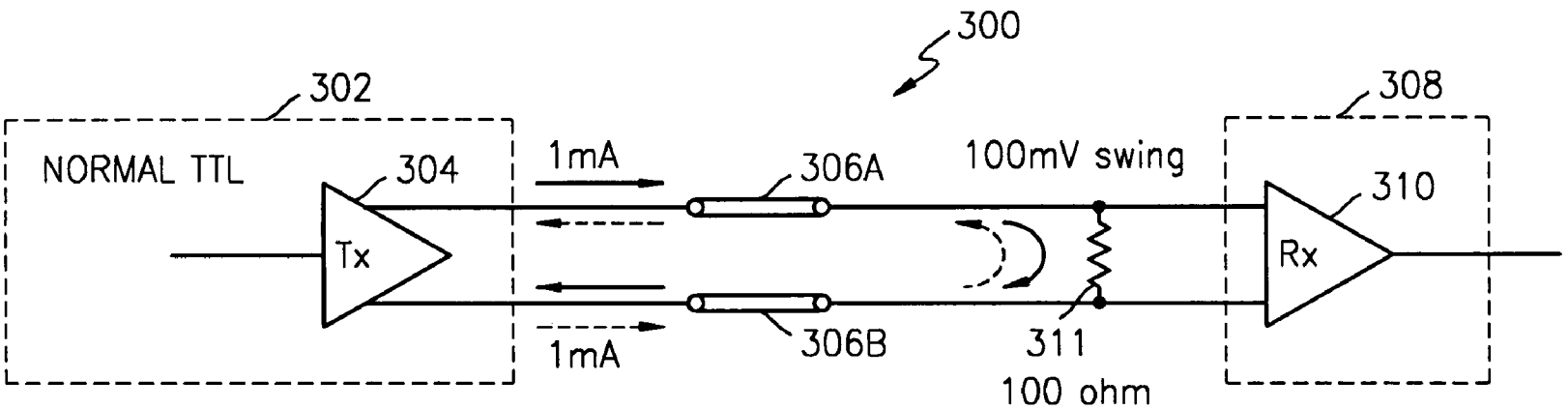
FIG. 3A (BACKGROUND ART)
FIG. 3A depicts a simplified schematic block diagram of an RSDS bus system 300 according to the Background Art.
Figure 3B:
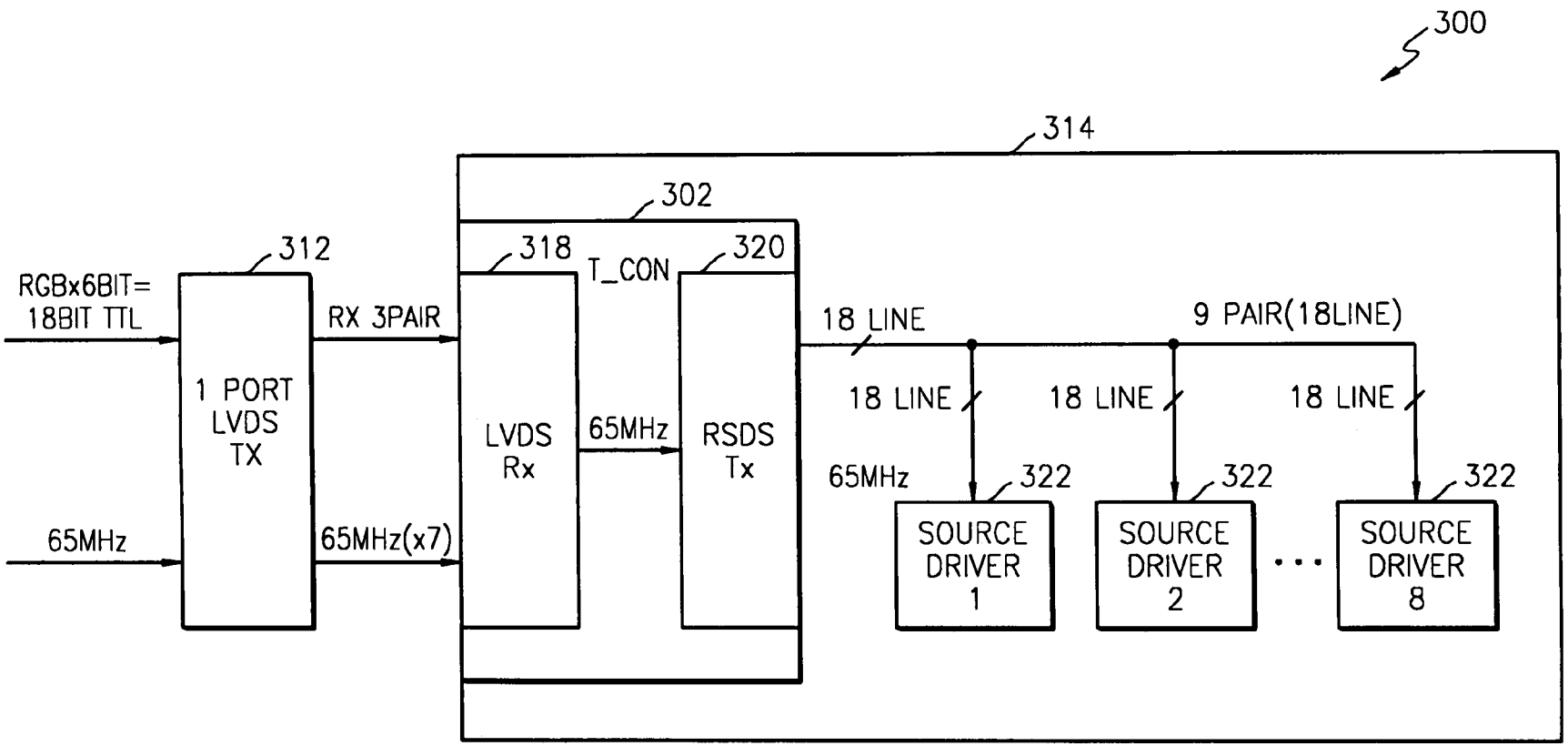
FIG. 3B (BACKGROUND ART)
FIG. 3B depicts a more detailed version of the RSDS bus system of FIG. 3A.
Figure 3C:
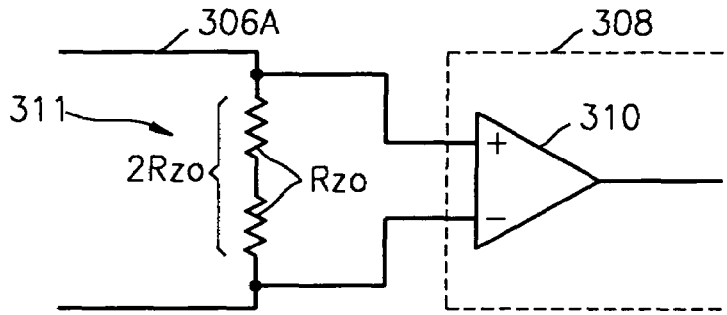
FIG. 3C (BACKGROUND ART)
FIG. 3C depicts the sensing circuitry of FIG. 3A in more detail.
Figure 3D:
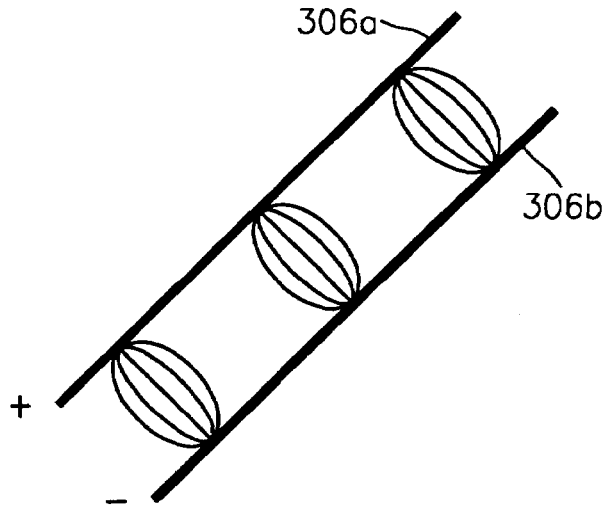
FIG. 3D (BACKGROUND ART)
FIGS. 3D and 3E depict the electric field and the magnetic field, respectively of the transmission line arrangement of FIGS. 3A and 3B.
Figure 3E:
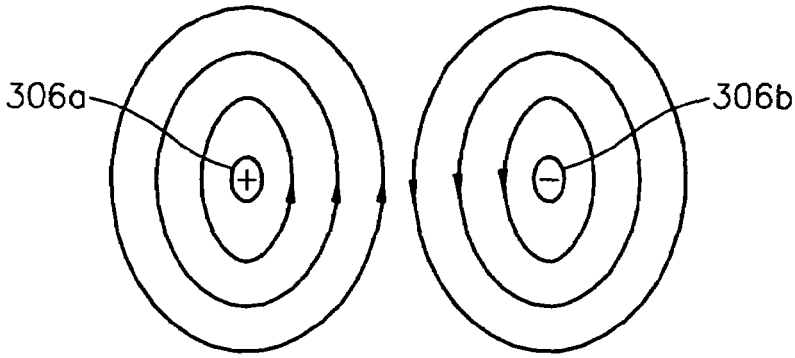
FIG. 3E (BACKGROUND ART)
Figure 4A:
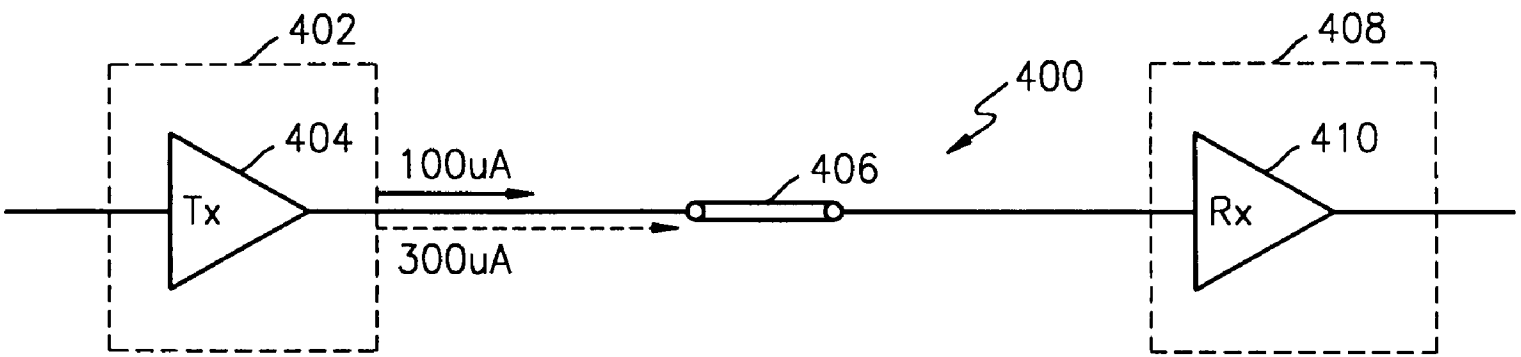
FIG. 4A (BACKGROUND ART)
FIG. 4A depicts a simplified schematic block diagram of the Whisper Bus system 400 according to the Background Art.
Figure 4B:
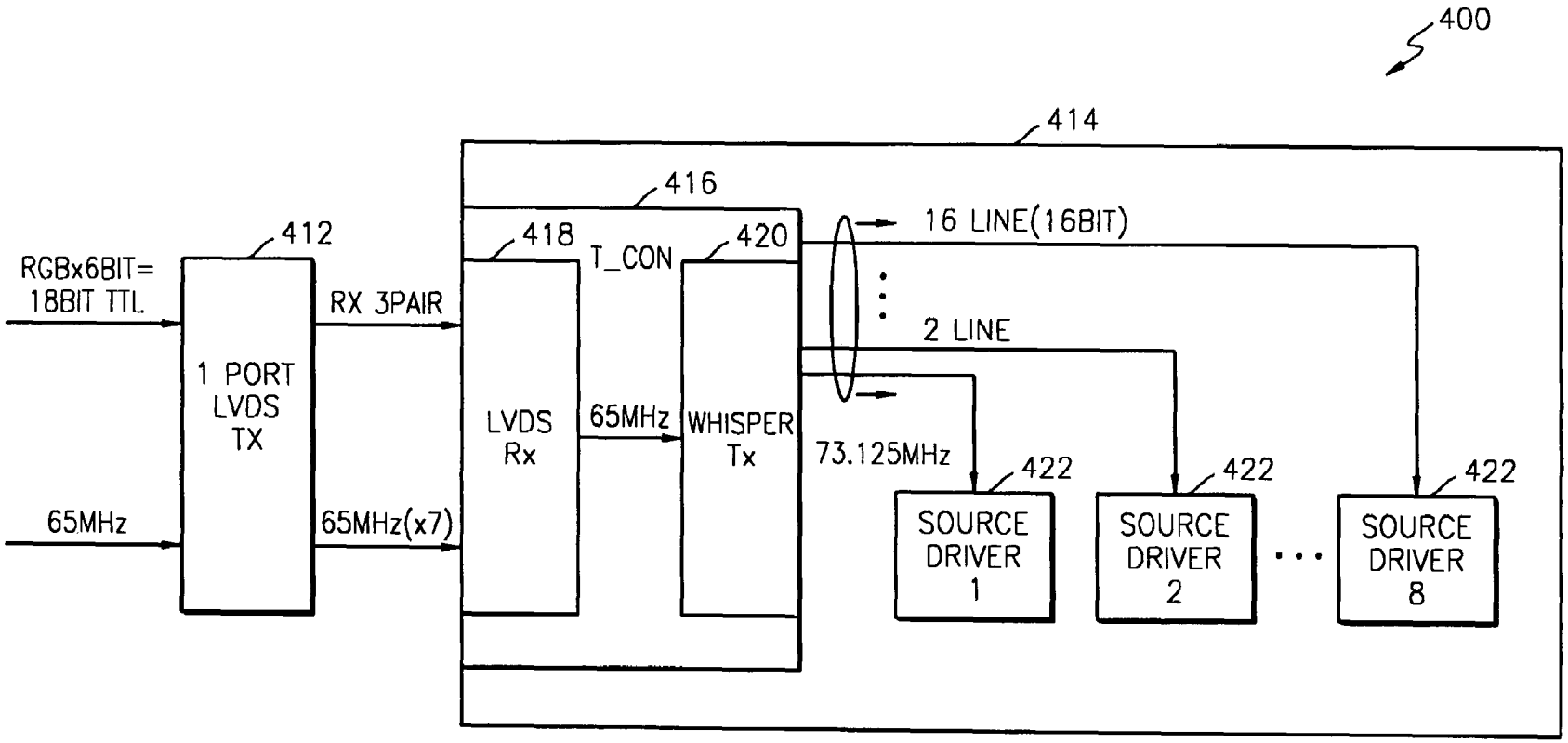
FIG. 4B (BACKGROUND ART)
FIG. 4B depicts a more detailed version of the Whisper Bus system of FIG. 4A.
Figure 4C:
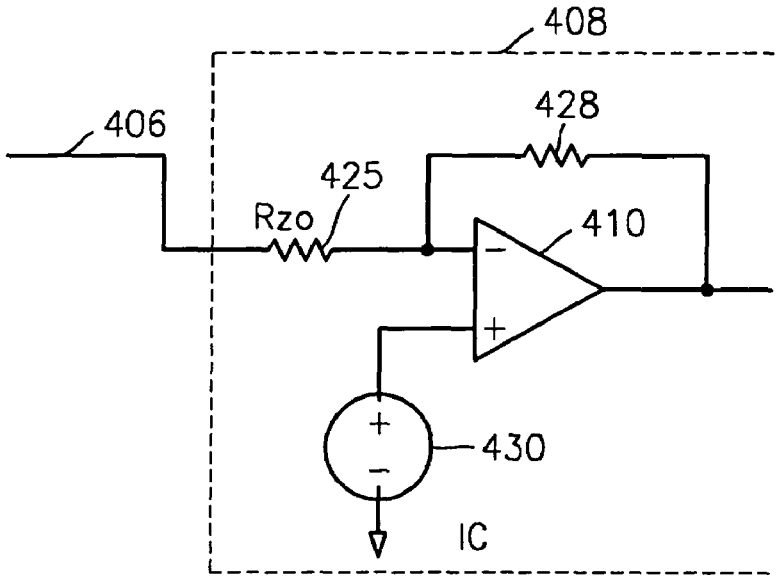
FIG. 4C (BACKGROUND ART)
FIG. 4C depicts the sensing circuitry of FIG. 4A in more detail.

An embodiment of the present inventions provides a method of receiving data signals over data lines, the method comprising: organizing said data lines into groups, each group having N input data signals and M reference signals, wherein N is a non-zero, positive integer; associating M reference signals on M reference lines with each group of N input data lines, wherein M is a non-zero, positive integer and N>M and receiving data on said data lines and reference signals on said reference lines and determining, for each group, data values on said data lines according to differences between signal parameters on said N data lines and signal parameters on said M reference lines, respectively.

An embodiment of the invention provides a method of transmitting data signals over data lines, the method comprising: organizing said data lines into groups, each group having N input data signals, wherein N is a non-zero, positive integer; associating M reference signals on M reference lines with each group of N input data lines, wherein M is a non-zero, positive integer and N>M; and transmitting data on said data lines and reference signals on said reference lines; wherein, for each group, data values on said data lines can be determined according to differences between signal parameters on said N data lines and signal parameters on said M reference lines, respectively.

An embodiment of the invention provides a receiver of data signals provided over data lines, the receiver comprising: an input unit to receive N input data signals on N data lines and M reference signals on M reference lines, wherein N and M are non-zero, positive integers and N>M; and a determining unit to determine data values on said data lines according to differences between signal parameters on said N data lines and signal parameters on said M reference lines, respectively.

An embodiment of the present invention provides a transmitter of data signals over data lines, the transmitter comprising: a data output unit to transmit N data signals on N data lines, where N is a non-zero positive integer; and a reference output unit to transmit M reference signals on M reference lines, wherein M is a non-zero, positive integer and N>M; wherein data values on particular ones of said data lines can be determined at a receiver according to differences between signal parameters on said N data lines and signal parameters on said M reference lines.

An embodiment of the present invention provides a flat panel display device having a display panel organized as a grid of data lines and gate lines, the device comprising: a plurality of data driver circuits for driving respective ones of said data lines, each data driver circuit receiving N data signals on N input data lines and M reference signals on M reference lines, wherein N and M are non-zero, positive integers and N>M; and wherein each data driver circuit is operable to determine data values on a particular one of said data lines according to a difference between at least one signal parameter on the particular data line and at least one signal parameter on the reference line.

In part to improve noise immunity, embodiments of the present invention provide an alternative differential signaling scheme, which will be referred to as a current mode scheme Such embodiments provide a reference transmission line for one or more corresponding data transmission lines. Because both the reference line and the one or more data lines are similarly affected by external noise, the differential data extraction is substantially unaffected by the external noise.

Figure 5A:
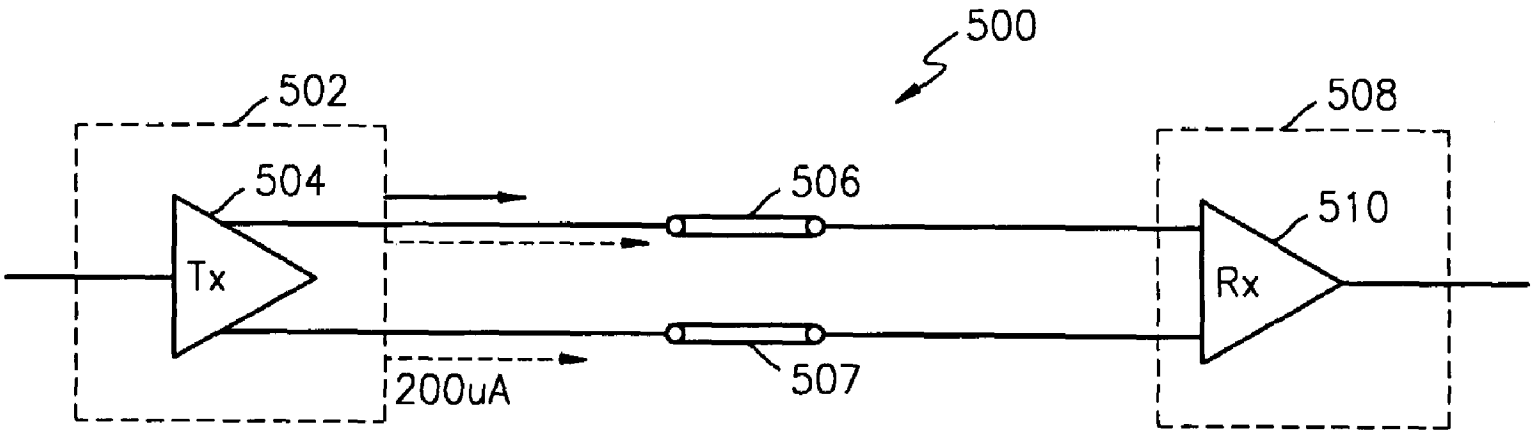
FIG. 5A depicts a simplified schematic block diagram of an embodiment of the present invention.

A simplified schematic block diagram of an embodiment of the present invention is depicted in FIG. 5A. The current mode display system 500 of FIG. 5A includes a transmission controller (T_CON) 502 (which includes a transmitter (TX) 504), a data transmission line 506, a reference transmission line 507 and a source driver 508 (which includes a receiver (RX) 510). A more detailed depiction of FIG. 5A is found in FIG. 5B, which depicts a low voltage differential single (LVDS) transmitter 512 and an LCD device 514. It is assumed in FIG. 5B (as a non-limiting example) that the transmitter 512 receives 18 bits total RGB data for each pixel; other gray-scale bit lengths can be used.

The LCD device 514 includes the timing controller 502 and a plurality of, e.g., eight, source drivers $\mathbf{501}_1$, $\mathbf{508}_2$, . . . $\mathbf{508}_8$. The transmission controller 502 includes an LVDS receiver 518 and a current mode transmitter 520. The system 500 supports the extended graphics array. (XGA) mode having 1024 columns and 768 rows (1024×768). Each of the source drivers 508 in FIG. 5B drives 384 columns or channels (1024×3 (for RGB)/8).

Figure 6A:
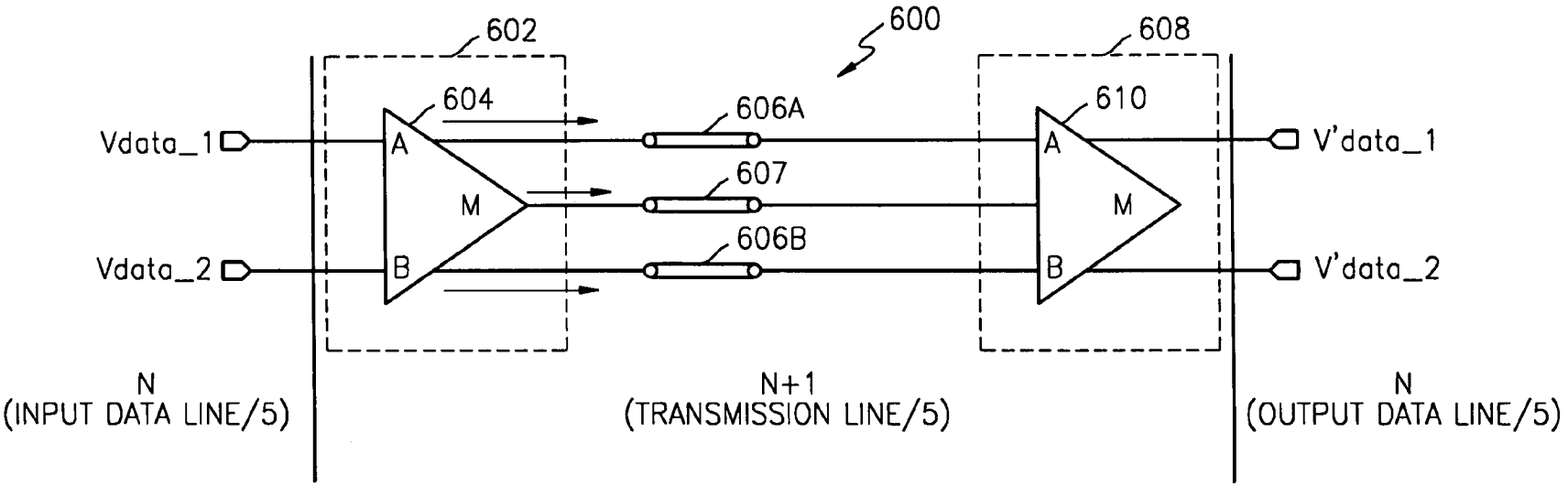
FIG. 6A depicts a simplified schematic block diagram of another embodiment according to the present invention.

FIG. 6A depicts a simplified schematic block diagram of another embodiment according to the present invention. The current mode display system 600 of FIG. 6A includes a transmission controller 602 (which includes a transmitter 604), data transmission lines 606A and 606B, a reference transmission line 607, and a source driver 608 (which includes a receiver 610).

Figure 5B:
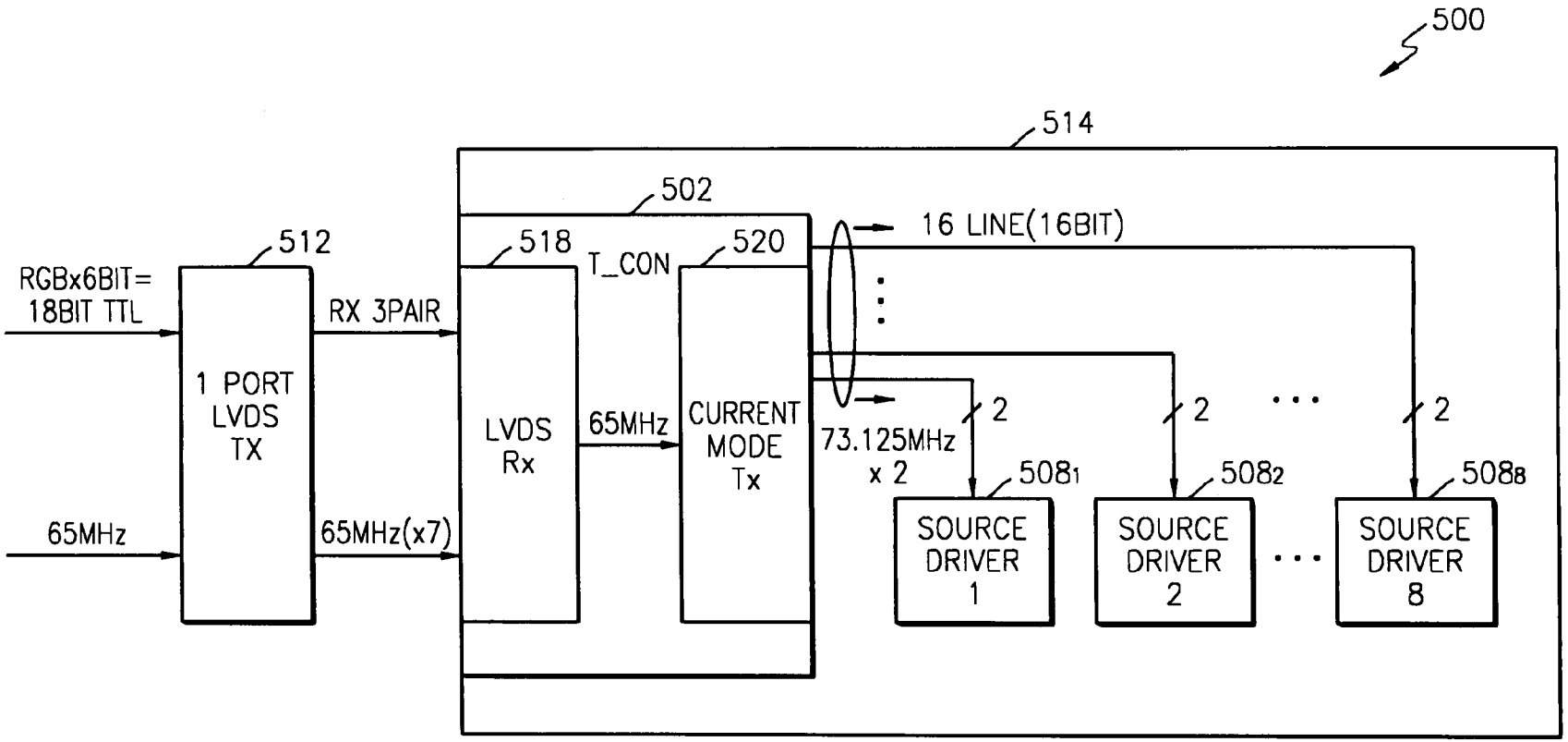
FIG. 5B depicts the system of FIG. 5A in more detail.
Figure 6B:
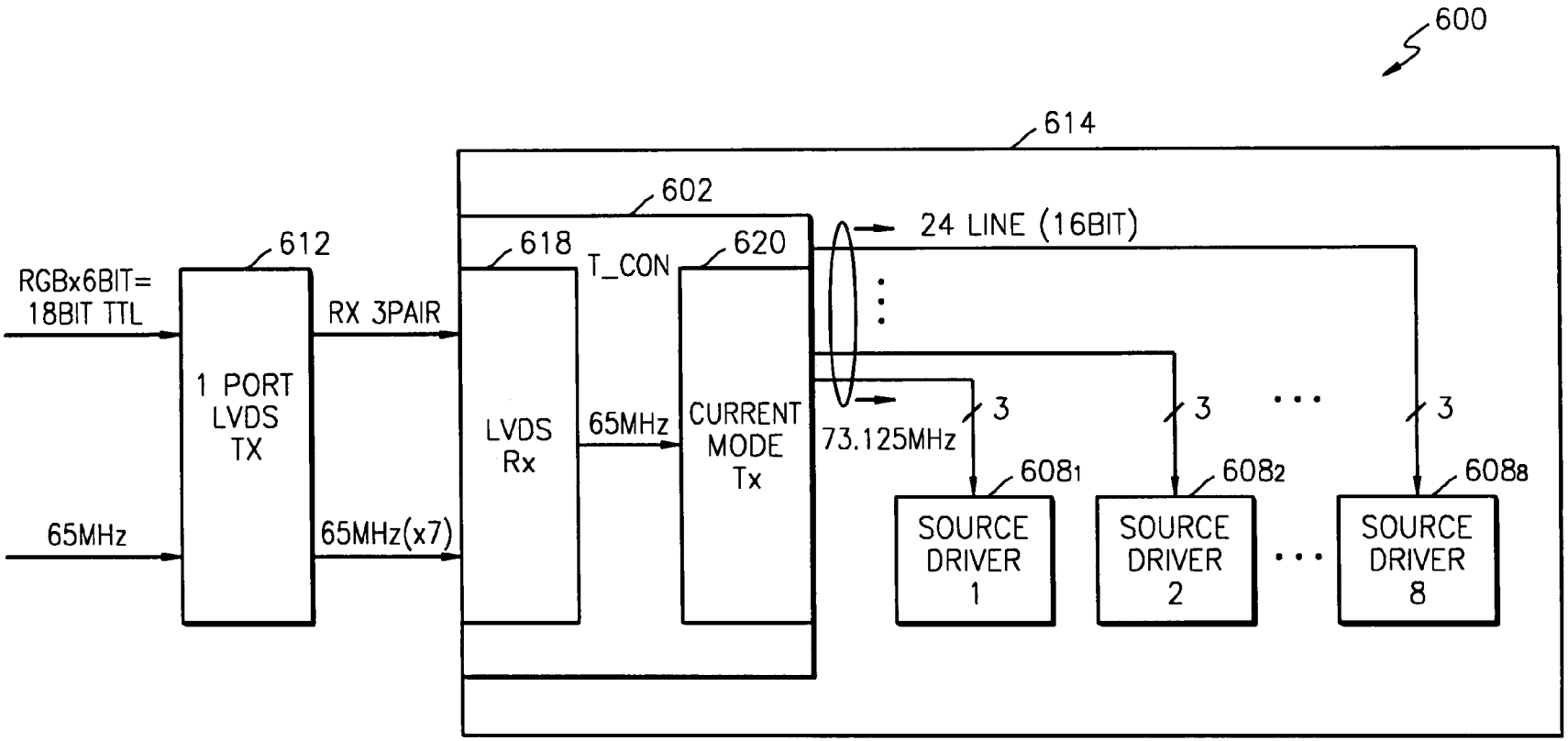
FIG. 6B depicts the system 600 of FIG. 6A in more detail.

FIG. 6B depicts the system 600 of FIG. 6A in more detail. In FIG. 6B, the system 600 includes an LVDS transmitter 612 and an LCD device 614. It is assumed in FIG. 6B (as a non-limiting example) that the transmitter 612 receives 18 bits total RGB data for each pixel; other gray-scale bit lengths can be used. The LCD device 614 includes the timing controller 602 and a plurality, e.g., eight, of source drivers $\mathbf{608}_1$, $\mathbf{608}_2$, . . . $\mathbf{608}_8$. The timing controller 602 includes an LVDS receiver 618 and a current mode transmitter 620. The source drivers 608 of the system 600, like the source drivers 508 of FIG. 5B, each drive 384 columns or channels.

The embodiments of FIGS. 5A and 5B have the same ratio of data transmission lines and reference transmission lines as the Background Art RSDS technology, one reference transmission line per data transmission line (1:1). As such, this embodiment does not have an advantage in this respect, but does so in others including noise immunity and possessing internal terminating elements rather than external (to be discussed further below).

In contrast to the 1:1 ratio of FIGS. 5A and 5B, the embodiment of FIGS. 6A and 6B exhibits a ratio of two data transmission lines for each reference line (2:1). The total bus width of the embodiment of FIGS. 6A and 6B is 25% smaller than the total bus width of the embodiment of FIGS. 5A and 5B. Hence, the embodiments of FIGS. 6A and 6B consume a smaller amount of PCB surface area than does the embodiment of FIGS. 5A and 5B. As the number of data transmission lines sharing a reference transmission line increases, the amount of PCB surface area consumed correspondingly decreases.

FIGS. 5A and 5B have been described as simplified. Each depicts a size grouping of N data transmission lines and one reference transmission, plus a transmitter and a receiver. In FIG. 5A, N=1 and, in FIG. 6A, N=2. In a plurality of such groups, along with a corresponding transmitter and receiver for each are expected to be present.

Figure 7:
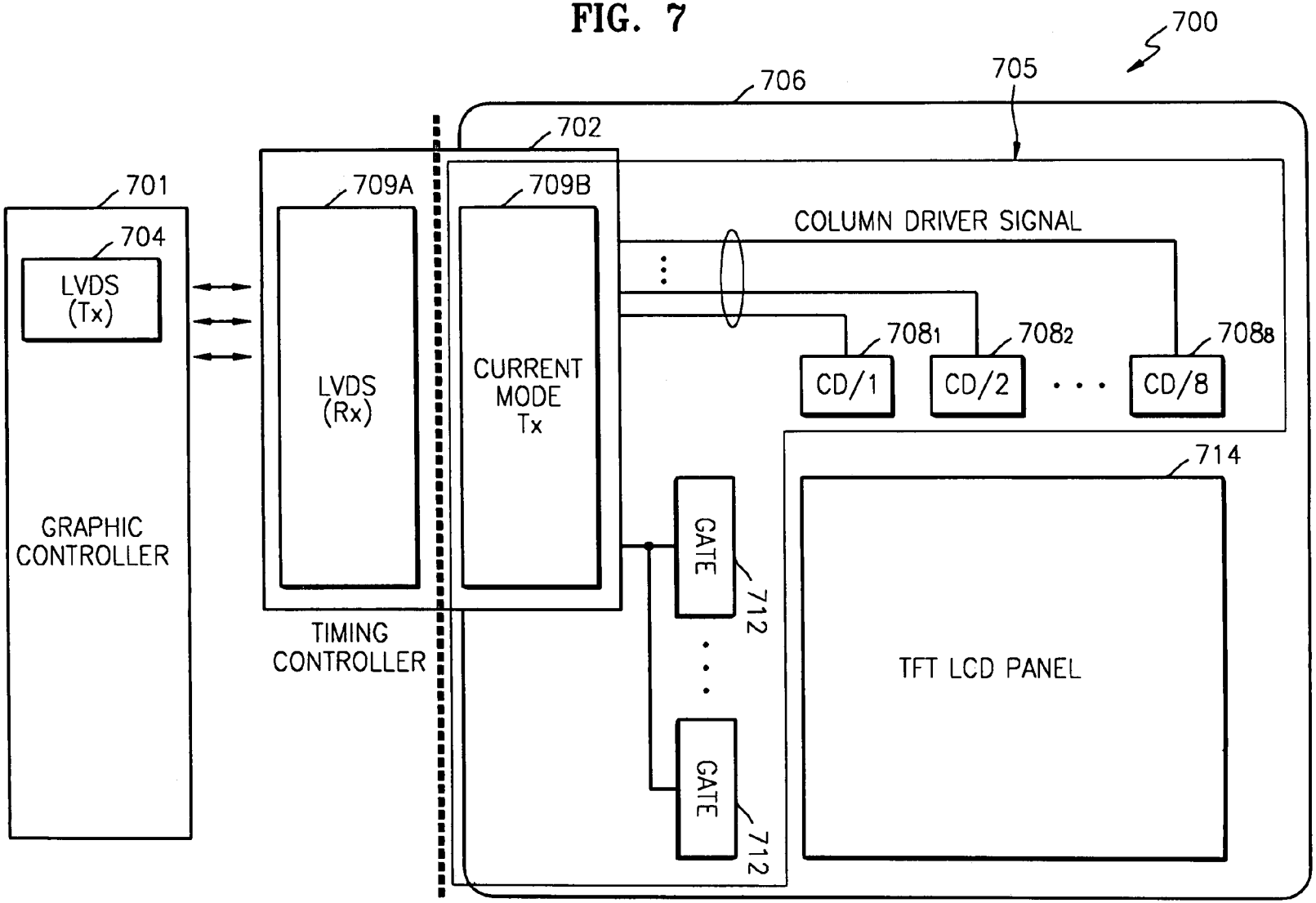
FIG. 7 depicts a schematic block diagram of a current mode display system 700 according to another embodiment of the present invention.

FIG. 7 depicts a schematic block diagram of a current mode display system according to another embodiment of the present invention. The system 700 includes a graphic controller 701 (which has an LVDS transmitter 704) and an LCD device 706. The LCD device 706 includes: a timing controller 702; a plurality, e.g., eight, of column drivers $\mathbf{708}_2$, $\mathbf{708}_2$, . . . $\mathbf{708}_8$; a plurality of gate drivers 712 (of an appropriate number corresponding to the number of rows of the relevant display format), and a thin film transistor (TET) LCD panel 714. The timing controller 708 includes an LVDS receiver 709A and a current mode transmitter 709B. The LCD device 706 (except for the TFT-LCD panel 714) can be constructed using chip on film (COF) technology (that forms integrated circuits directly on a film 705). As such, the current mode transmitter 709B of the timing controller 708 is depicted as being on the PCB or film 705.

Figure 8:
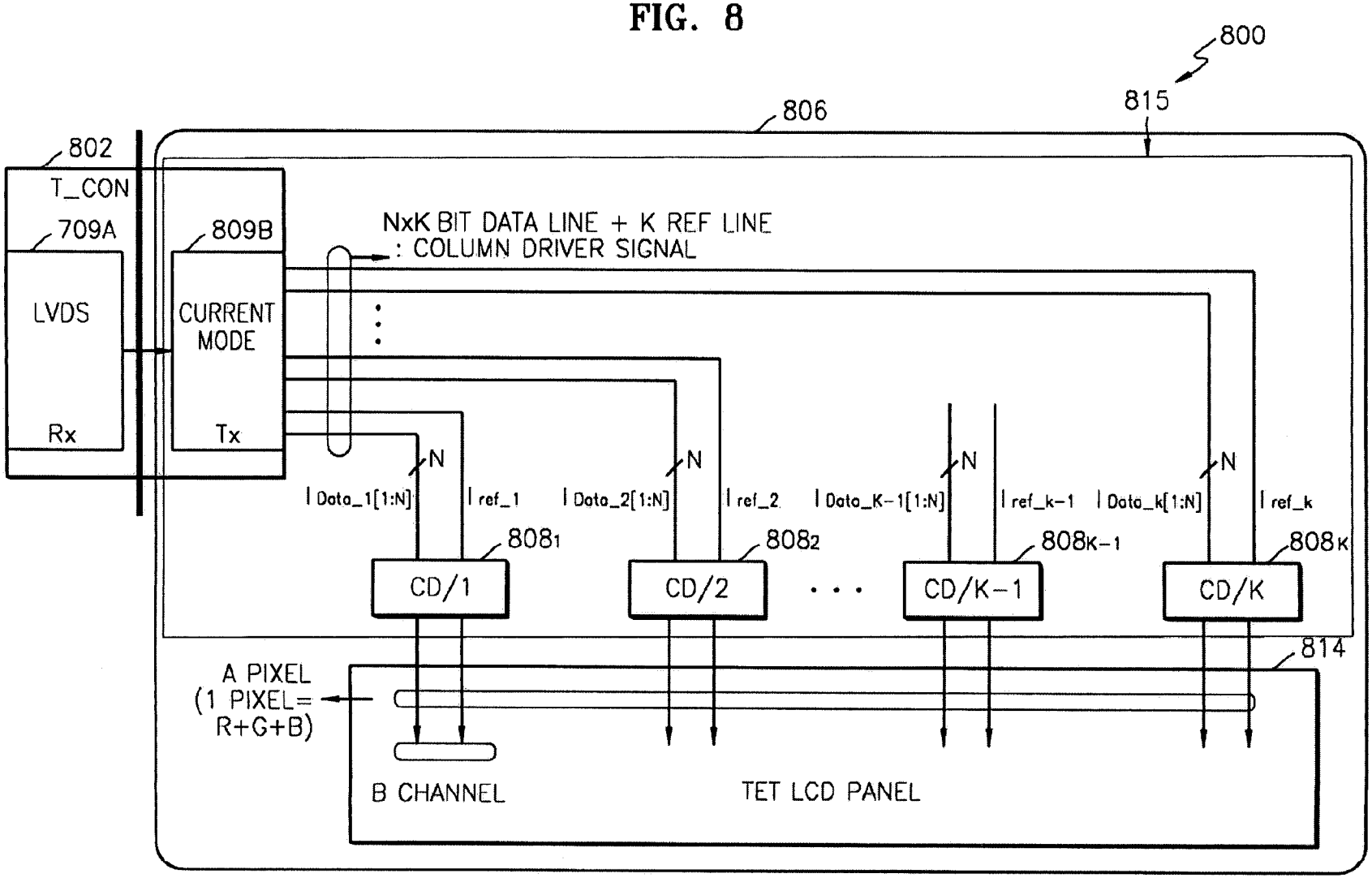
FIG. 8 depicts a current mode display system 800 according to another embodiment of the present invention.

FIG. 8 depicts an embodiment of another current mode display system 800 according to the present invention. FIG. 8 corresponds to FIG. 7, but is less detailed in some respects and yet more generalized with respect to the number of column drivers. The system 800 has a timing controller 802 and an LCD device 806. Like FIG. 7, the LCD device 806 (except for the TFT-LCD panel 814 of FIG. 8) is formed on the PCB or film 815. The timing controller 802 includes an LVDS receiver 709A and a current mode transmitter 809B. The current mode transmitter 809B is depicted as being formed on the PCB or film 815.

The LCD device 806 also includes K column drivers, where K is a positive integer, $\mathbf{808}_1$, $\mathbf{808}_2$, . . . $\mathbf{808}_{K-1}$ and $\mathbf{808}_K$. Each column driver (CD) 808 is provided with N data transmission lines, where N is a positive integer, and a reference transmission line from the current mode transmitter 809B. The variable N can be as small as one or as large as is considered practical for the particular situation in which such a current mode display system is implemented.

Figure 9:
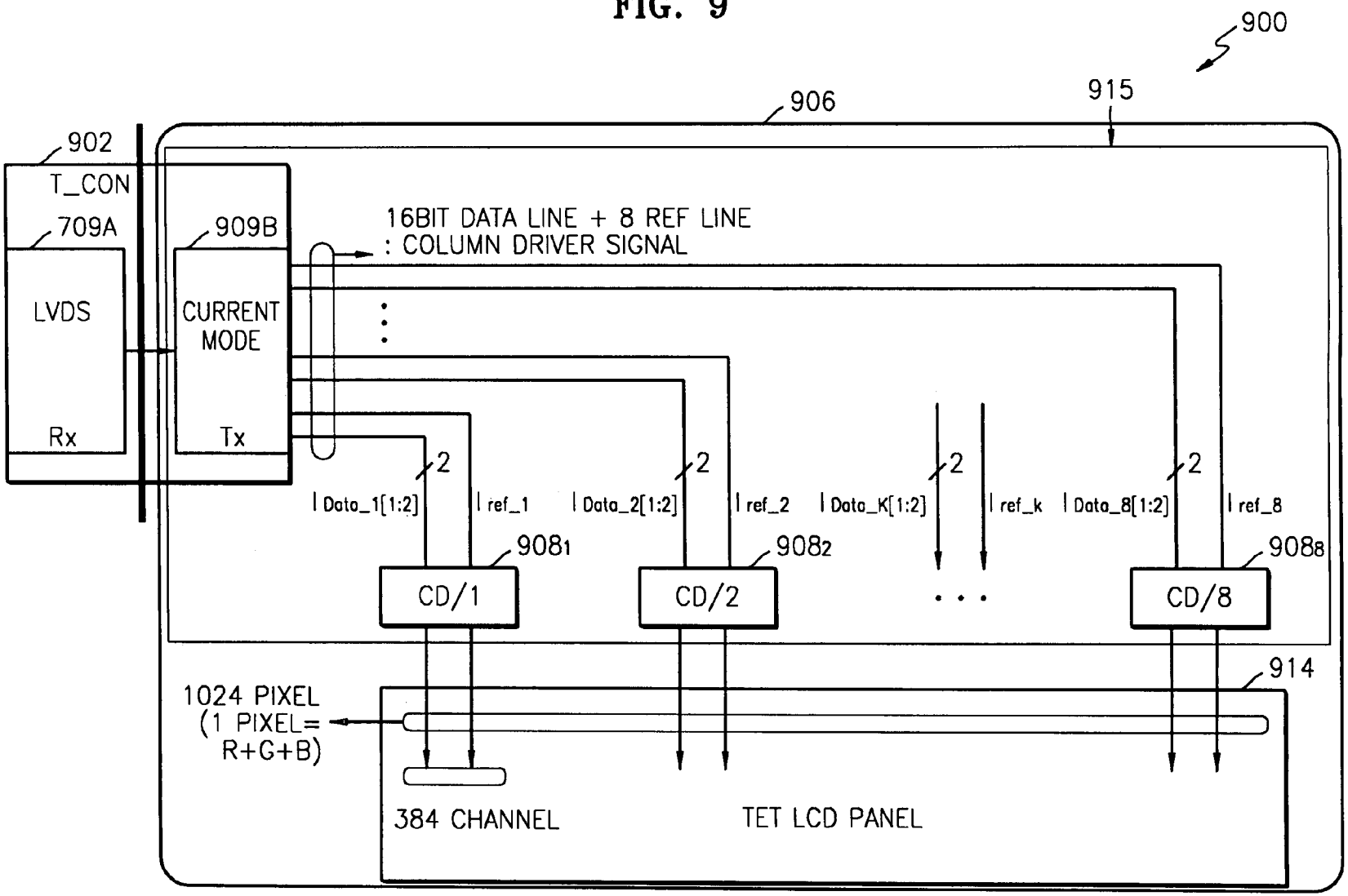
FIG. 9 depicts a current mode display system 900 according to another embodiment of the present invention.

FIG. 9 depicts a current mode display system according to an embodiment of the present invention. FIG. 9 corresponds to FIG. 8 for the situation in which K=8 and N=2. The system 900 includes a timing controller 902 and an LCD device 906 (except for the TFT-LCD panel 914) on the PCB or film 915. The system 900 of FIG. 9 conforms to the XGA format (1024×768). Each of the column drivers 908 drives 384 columns or channels (1024×3/8).

The timing controller 902 includes an LDVS receiver 709A and a current mode transmitter 909B. The LCD device 906 includes column (source) drivers $\mathbf{908}_1$, $\mathbf{908}_2$, . . . $\mathbf{908}_8$. Each column driver 908 is provided with two data transmission lines and one reference transmission line. For example, column driver $\mathbf{908}_1$ receives the signals $I_{Data_1[1:2]}$ and $I_{ref_1}$, column $\mathbf{908}_2$ receives the signals $I_{Data_2[1:2]}$ and $I_{ref_2}$, etc. Each of the column drivers 908 drives 384 columns or channels (1024×3(for RGB)/8). FIG. 9 corresponds to FIGS. 6A and 6B in the sense that one reference transmission line is provided for every two data transmission lines. As such, the total width of the data bus of the embodiment of FIG. 9 is 25% less than the total data bus width of the embodiment of FIGS. 5A and 5B.

Figure 10:
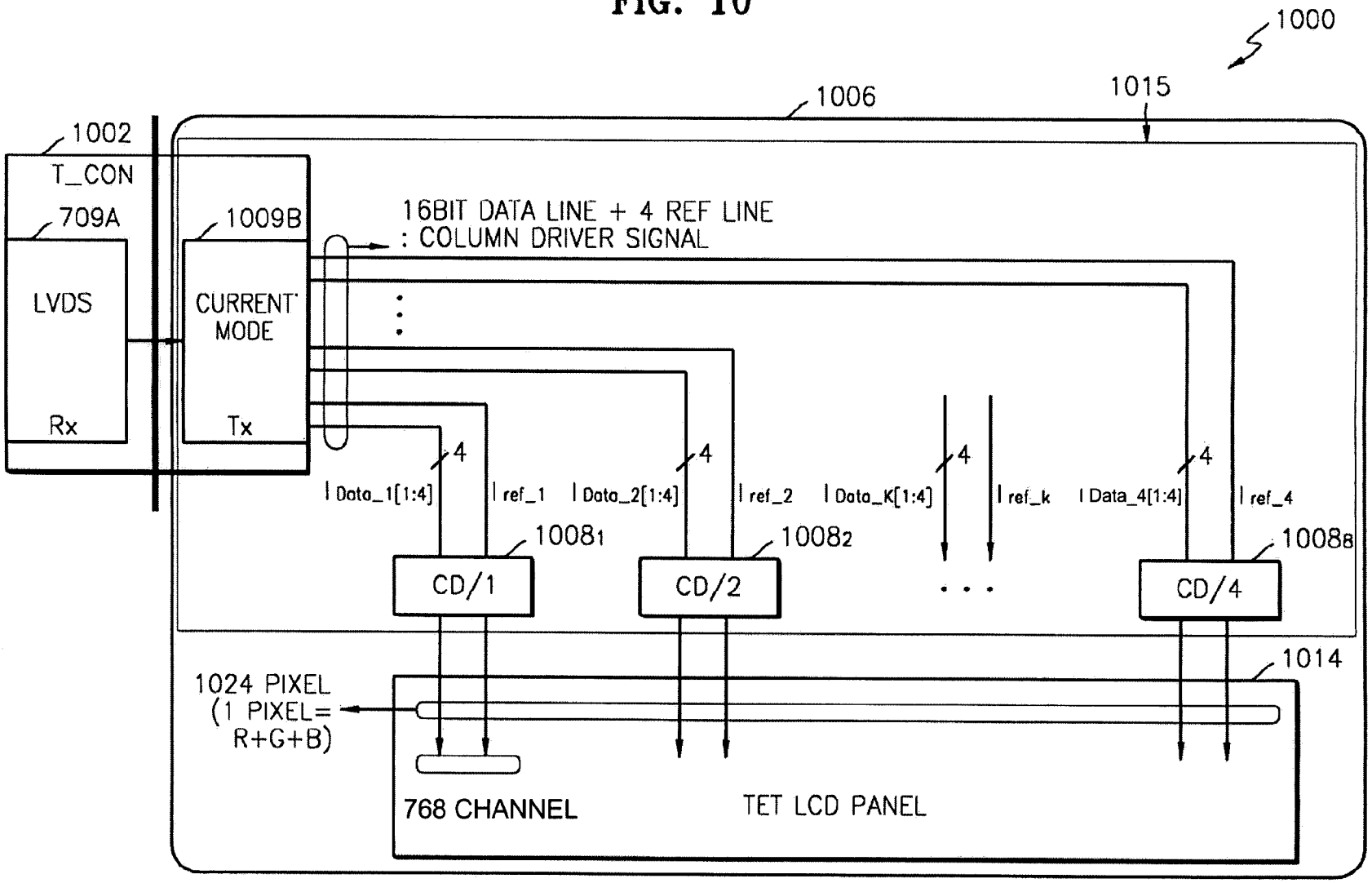
FIG. 10 depicts a current mode display system 1000 according to another embodiment of the invention.

FIG. 10 depicts a current mode display system 1000 according to an embodiment of the invention. FIG. 10 corresponds to FIG. 8 for the circumstance in which K=4 and N=4. The system 1000 of FIG. 10 conforms to the XGA format (1024×768). Each of the column drivers 1008 in FIG. 10 drives 768 columns or channels (1024×3(RGB)/4). The system 1000 includes a timing controller 1002 and an LCD device 1006 (except for the TFT-LCD panel 1014) on the PCB or film 1015. The timing controller 1002 includes an LVDS receiver 709A and a current mode transmitter 1009B. The current mode transmitter 1009B is shown as being formed on the PCB or film 1015.

The LCD device 1006 also includes four column drivers $\mathbf{1008}_1$, $\mathbf{1008}_2$, . . . $\mathbf{1008}_4$. Each of the column drivers 1008 is provided with four data transmission lines and one reference transmission line. In comparison to the embodiments of FIGS. 5A and 5B (which uses four reference transmission lines for every four data transmission lines), the embodiment of FIG. 10 uses one transmission line for every four data transmission lines, which represents a reduction by 37.5% in the total width of the data bus.

Figure 11:
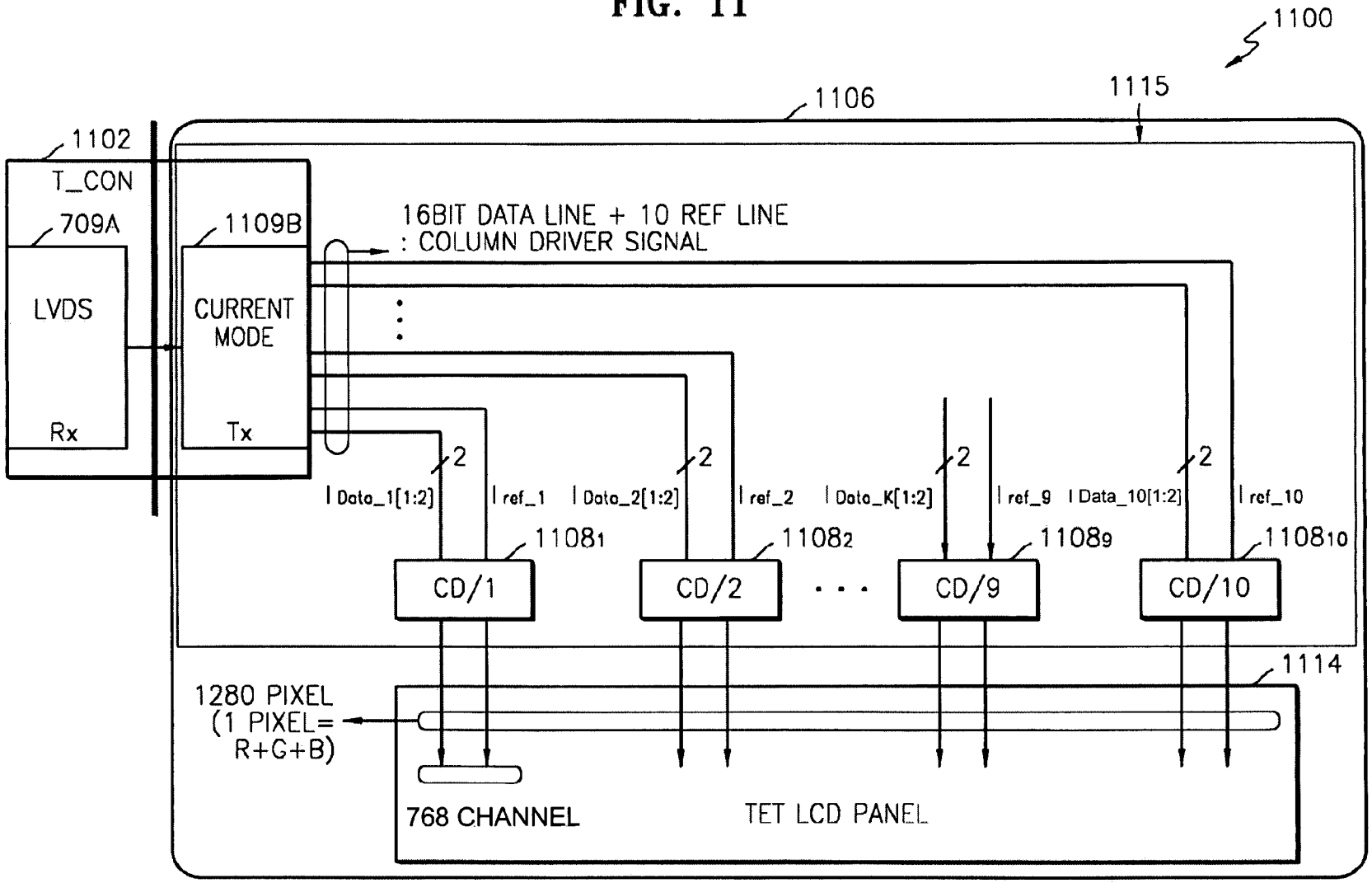
FIG. 11 depicts a current mode display system according to another embodiment of the present invention.

FIG. 11 depicts a current mode display system according to an embodiment of the present invention. FIG. 11 corresponds to FIG. 8 for the circumstance in which K=10 and N=2. The system 1100 of FIG. 11 conforms to the UXGA format (1280×1024). Each of the column drivers 1108 drives 384 columns or channels (1280×3(RGB/10). FIG. 11 employs reference numbers that correspond to FIGS. 8-10, hence such numbering need not be discussed further. The system 1100 uses one reference transmission line for every two data transmission lines. Hence, the total bus width of the system 1100 is 25% less than the system 500 of FIGS. 5A and 5B.

Figure 12:
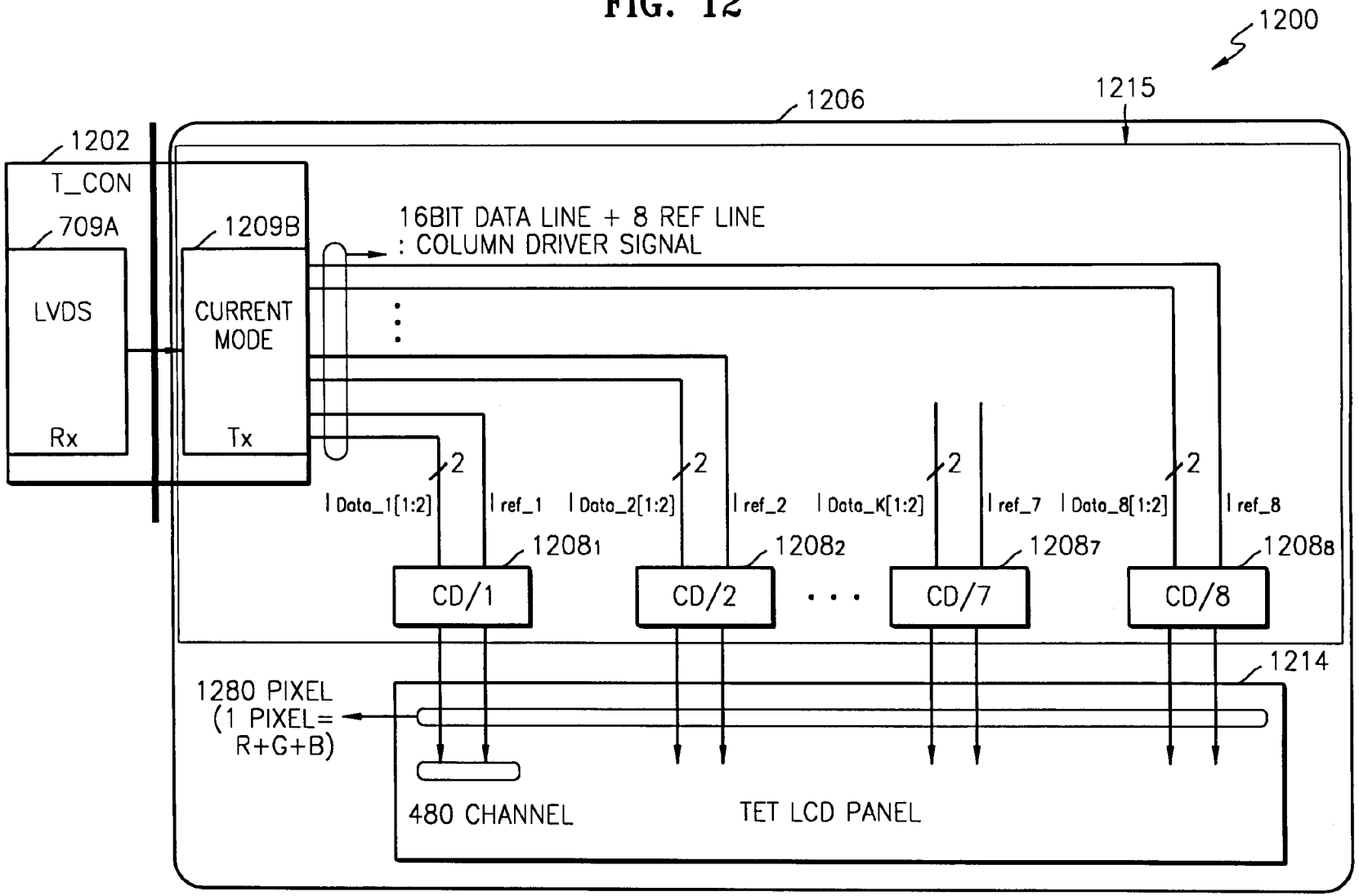
FIG. 12 depicts a current mode display system 1200 according to an embodiment of the present invention.

FIG. 12 depicts a current mode display system 1200 according to an embodiment of the present invention. The system 1200 of FIG. 12 conforms to the UXGA display format (1280×1024). Each of the column drivers 1208 drives 480 columns or channels (1280×3/8).

FIG. 12 corresponds to FIG. 8 for the circumstances in which K=8 and N=2. The numbering in FIG. 12 of components is similar to the convention adopted in FIGS. 8-11, hence no further itemization of the components of FIG. 12 will be provided. The TFT LCD panel 1214 conforms to the ultra extended graphics array (UXGA) format having 1280 columns and 1024 rows. As such, each of the column drivers 1208 drives 480 columns or channels (1280×3(RGB)/8). The system 1200 uses one reference transmission line for every two data transmission lines. Hence, the total bus width of the system 1200 is 25% less than the system 500 of FIGS. 5A and 5B.

Figure 13:
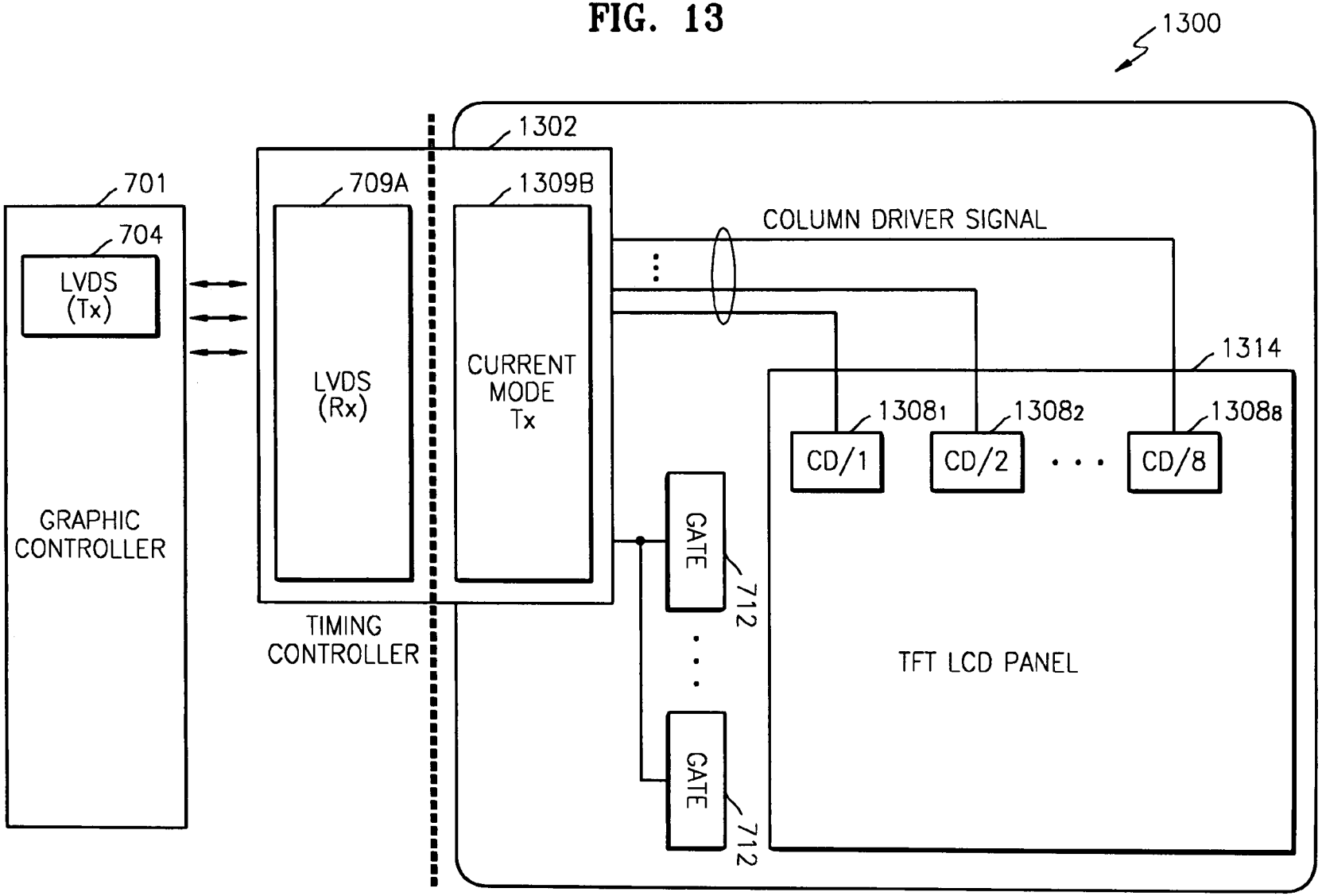
FIG. 13 depicts a current mode display system 1300 according to an embodiment of the invention.

FIG. 13 depicts a current mode display system 1300 according to an embodiment of the invention. In contrast to the embodiments of FIGS. 7-12, the embodiment of FIG. 13 is constructed using chip on glass (COG) technology. As such, FIG. 13 corresponds to FIG. 7 except that the column drivers $\mathbf{1308}_1$, $\mathbf{1308}_2$, . . . $\mathbf{1308}_8$ are depicted as being formed directly on the TFT LCD panel 1314 instead of on the PCB or film. For the sake of simplicity, it has been assumed in FIG. 13 that the number of column drivers is eight. That will not necessarily always be the case.

Figure 14:
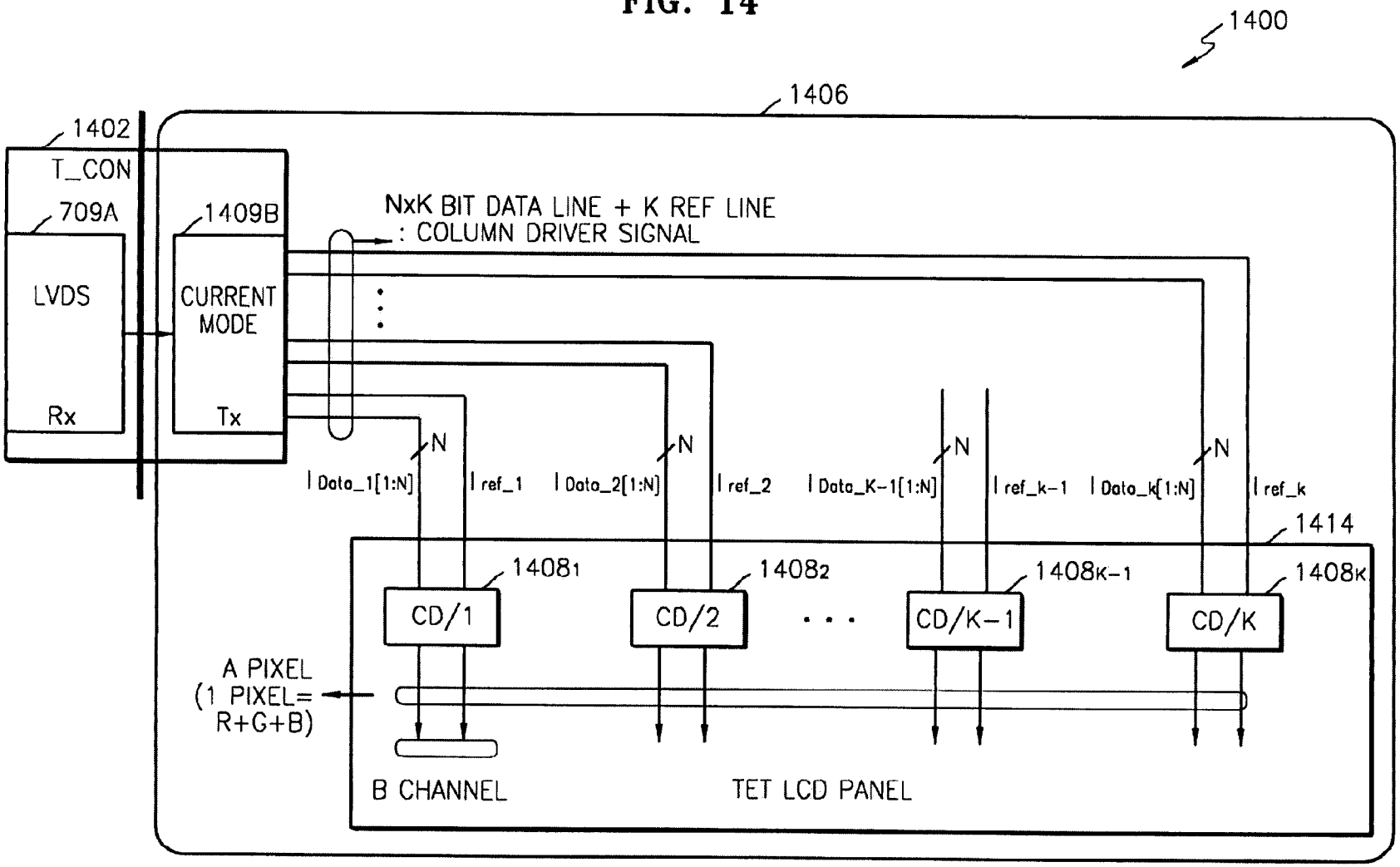
FIG. 14 depicts a current mode display system 1400 according to an embodiment of the invention.

FIG. 14 depicts a current mode display system 1400 according to an embodiment of the invention. FIG. 14 corresponds to FIG. 13 but is simplified except as it pertains to the number of column drivers, which has been generalized. More particularly, the system 1400 includes an LCD device 1406 and a timing controller 1402. The timing controller 1402 includes an LVDS receiver 709A and a current mode transmitter 1409B. It is to be noted that the transmitter 1409B is fanned on the PCB. As mentioned, FIG. 14 illustrates the general case in which a total of K column drivers 1408 are provided, where K is a positive integer. As such, column drivers $\mathbf{1408}_1$, $\mathbf{1408}_2$, . . . $\mathbf{1408}_{K-1}$ and $\mathbf{1408}_K$ are depicted. Each column driver 1408 receives one reference transmission line and N data transmission lines, where N is a positive integer. The column driver $\mathbf{1408}_1$ receives the data signal $I_{Data_1[1:N]}$ and the reference signal cap $I_{ref_1}$. The other column drivers receive similar signals. The ratio in FIG. 14 of data transmission lines to reference transmission lines is N:1.

Figure 15:
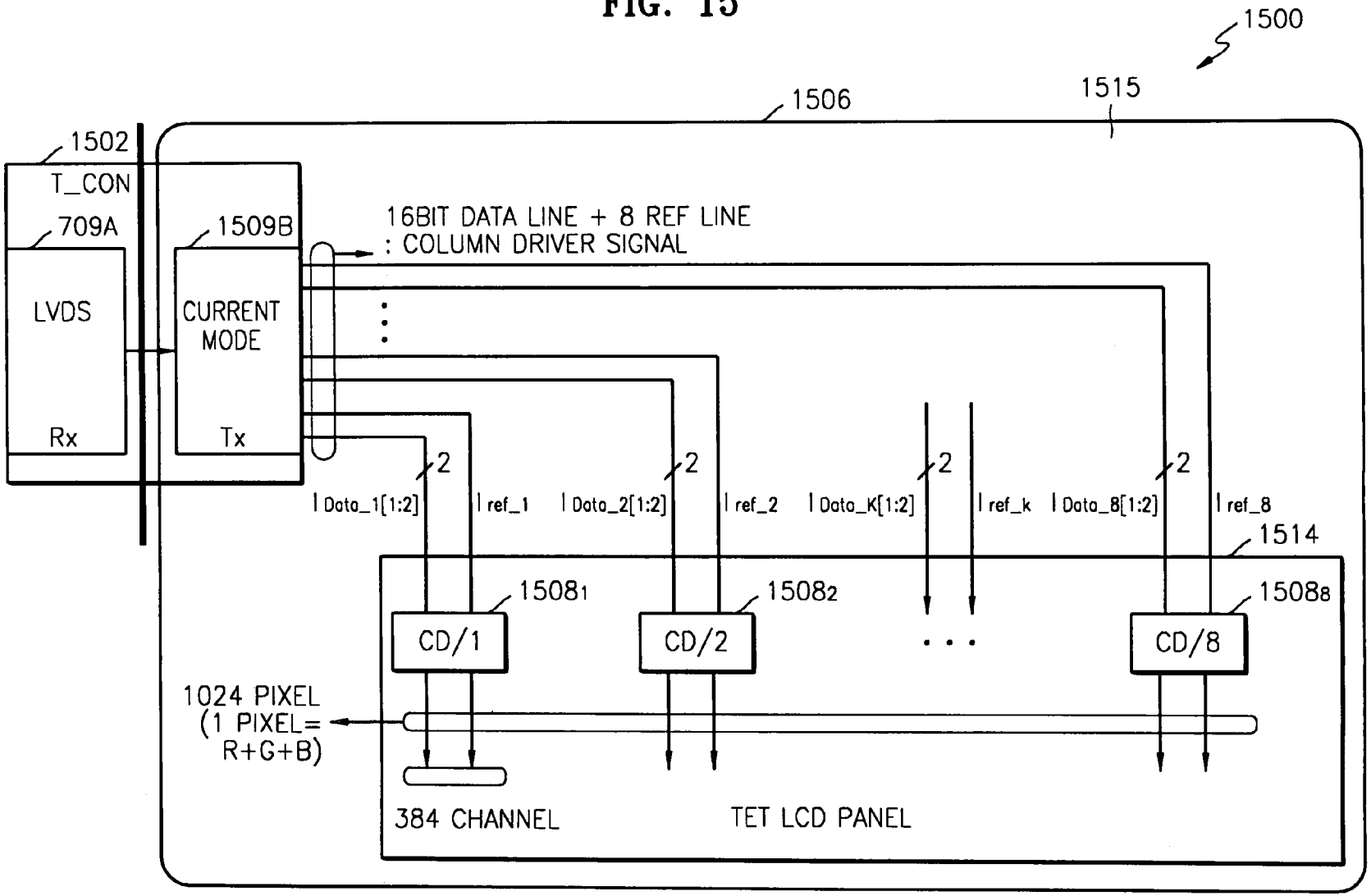
FIG. 15 depicts a current mode display system 1500 according to an embodiment of the invention.

FIG. 15 depicts a current mode display system 1500 according to an embodiment of the invention. FIG. 15 corresponds to FIG. 14 for the circumstance in which K=8 and N=2. As such, FIG. 15 also corresponds to FIG. 9. But the column drivers $\mathbf{1508}_1$, $\mathbf{1508}_2$, . . . $\mathbf{1508}_8$ are depicted as being formed on the TFT LCD panel 1514 whereas the column drivers $\mathbf{908}_1$, $\mathbf{908}_2$ . . . $\mathbf{908}_8$ are formed on the PCB or film. The total data bus width of FIG. 15 is the same as FIG. 9. Thus, the total bus width of FIG. 15 is 25% less than the total bus width of the embodiment of FIGS. 5A and 5B. Each of the column drivers 1508 of FIG. 15, like the column drivers 908 of FIG. 9, drives 384 columns or channels (1024 ×3/8).

Figure 16:
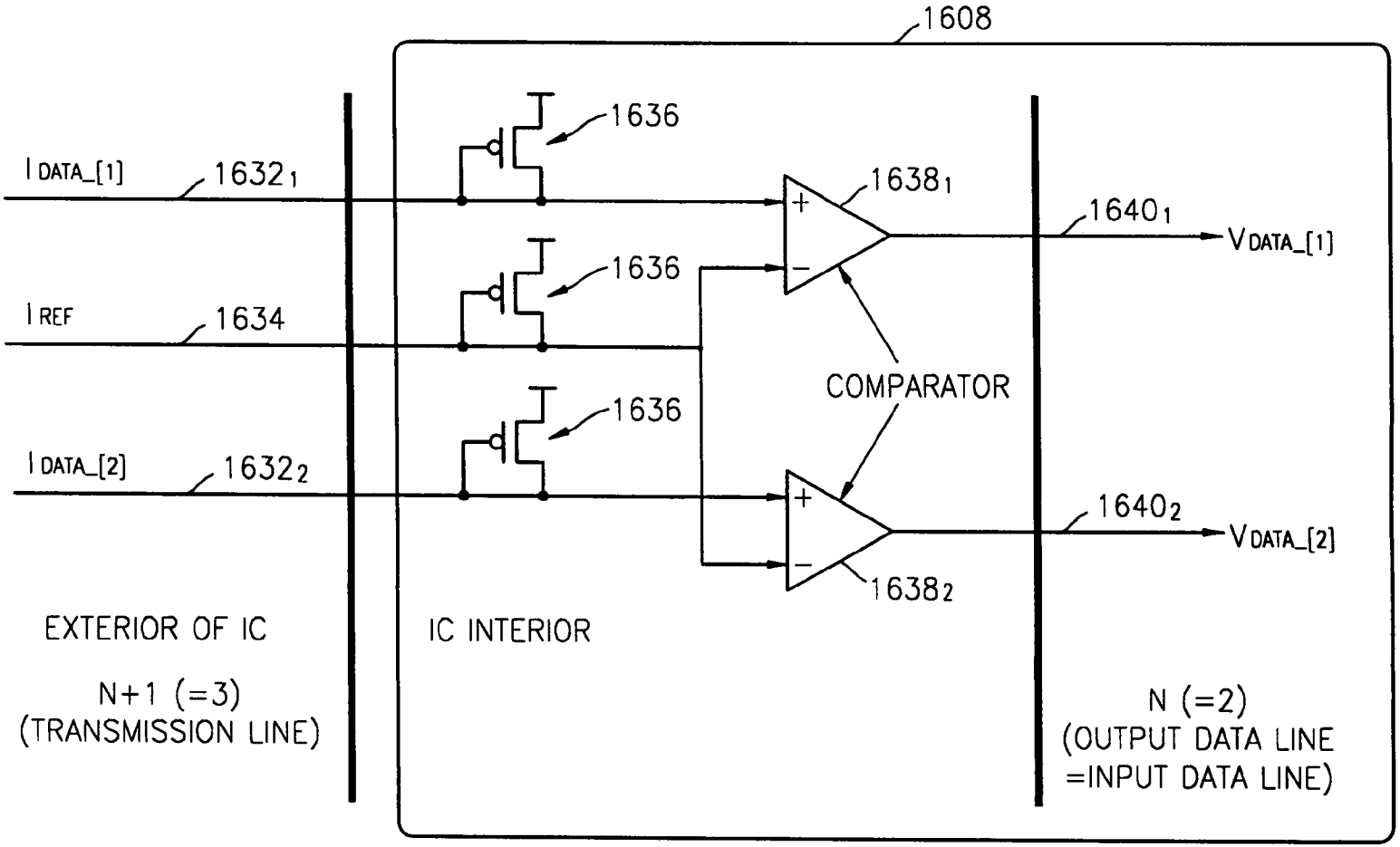
FIG. 16 depicts a source driver 1608 according to an embodiment of the present invention.

FIG. 16 depicts an embodiment of a source driver 1608 according to the present invention. The source driver 1608 can be formed according to the COF technology of FIGS. 7-12 or the COG technology of FIGS. 13-15, i.e., the source driver 1608 can be formed either on the TFT LCD panel or on the PCB. The source driver 1608 includes comparator $\mathbf{1638}_1$ and $\mathbf{1638}_2$. The non-inverting input of the comparator $\mathbf{1638}_1$, receives the signal $I_{Data_[1]}$ present on data transmission line $\mathbf{1632}_1$ that is connected to the non-inverting input via a terminating element 1636. The terminating element 1636 can be, e.g., a well known transistor circuit. More importantly, the terminating element 1636 can be formed on the same integrated circuit as the comparator $\mathbf{1638}_1$. The inverting input of the comparator $\mathbf{1638}_1$ is connected to a reference signal $I_{Ref}$ present on reference transmission line 1634 that is connected to the inverting terminal via another terminating element 1636. A second comparator $\mathbf{1638}_2$ shares the reference signal $I_{Ref}$ by also having its inverting input connected to the reference transmission line 1634 via its associated terminating element 1636. The non-inverting input of the comparator $\mathbf{1638}_2$ receives the signal $I_{Data_[2]}$ present on the data transmission line $\mathbf{1632}_2$ via another terminating element 1636. The output of comparator $\mathbf{1638}_1$, namely the signal $V_{Data_[1]}$, is provided on signal line $\mathbf{1640}_1$. The output of the comparator $\mathbf{1638}_2$, namely the signal $V_{Data_[2]}$, is provided on he signal line $\mathbf{1640}_2$.

Figure 17:
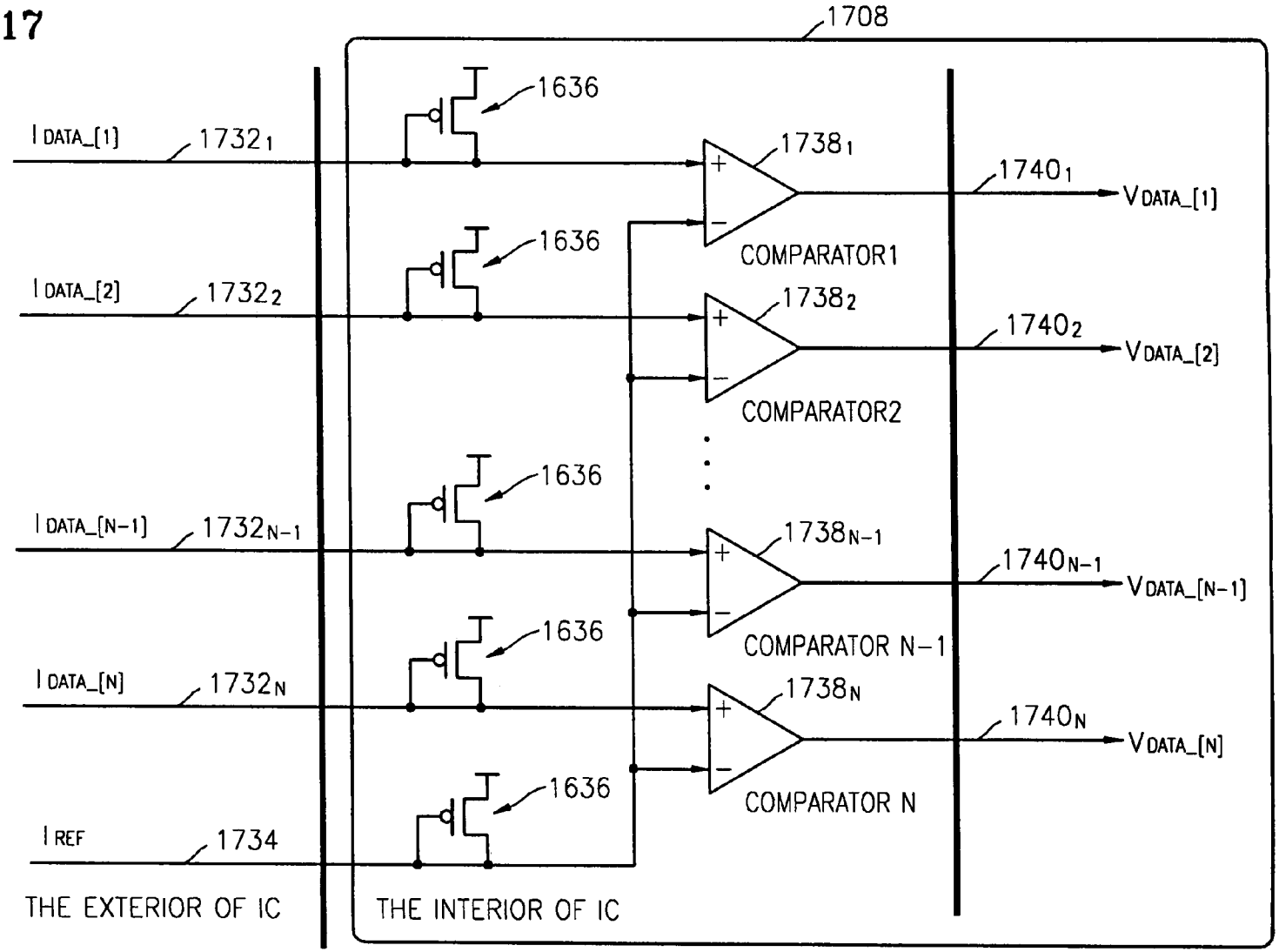
FIG. 17 depicts an alternative source driver 1708 according to an embodiment of the invention.

FIG. 17 depicts an alternative source driver 1708 according to an embodiment of the invention that can be used, e.g., to implement the source drivers 608, 708, 808, 908, 1008, 1108, 1208, 1308, 1408 and 1508. The source driver 1708 corresponds to the source driver 1608 except that it is generalized for the situation in which one reference transmission line 1734 and a total of N data transmission lines $\mathbf{1732}_1$, $\mathbf{1732}_2$, $\mathbf{1732}_{N-1}$ and $\mathbf{1732}_N$ are provided, where N is a positive integer. Each of the transmission lines 1732 and 1734 are provided with a terminating transistor circuit 1636. The source driver 1708 is provided with N comparators $\mathbf{1738}_1$, $\mathbf{1738}_2$, . . . $\mathbf{1738}_{N-1}$ and $\mathbf{1738}_N$ having output signal line $\mathbf{1740}_1$, $\mathbf{1740}_2$, $\mathbf{1740}_{N-1}$ and $\mathbf{1740}_N$, respectively. The inverting inputs of the comparators are each connected to the reference transmission line 1734.

The comparators 1638 and 1738 can be formed according to well known transistor circuitry.

The embodiments of the present invention have been couched in terms of providing data signals to a flat panel display device. But other embodiments of the invention have broader applicability to any circuitry in which a high data rate, good noise immunity and relatively small physical bus width are desirable.

The invention may be embodied in other forms without departing from its spirit and essential characteristics. The described embodiments are to be considered only non-limiting examples of the invention. The scope of the invention is to be measured by the appended claims. All changes which come within the meaning and equivalency of the claims are to be embraced within their scope.

What is claimed:

1. A method of receiving data signals over data lines at a plurality of data driver circuits, the method comprising:

organizing said data lines into groups, each group including N input data lines, wherein N is a non-zero, positive integer, and each group being associated with one of the plurality of data driver circuits;

associating M reference lines with each group of N input data lines, wherein M is a non-zero, positive integer and N>M; and receiving, at each of the plurality of data driver circuits, N data signals on said N input data lines and M reference signals on said M reference lines; and determining, at each of the plurality of data driver circuits, data values on said N data lines according to differences between currents on said N input data lines and currents on said M reference lines, respectively.

2. The method of claim 1, wherein at least one of the following is true: M=1; and N=2.

3. The method of claim 1, wherein said data lines are part of a flat panel display device having a display panel organized as a grid of said data lines and gate lines.

4. The method of claim 3, wherein the flat panel display device is a liquid crystal display device.

5. A method of transmitting data signals to a plurality of data driver circuits over data lines, the method comprising:

organizing said data lines into groups, each group having N input data lines on which N input data signals are transmitted, wherein N is a non-zero, positive integer;

associating M reference lines with each group of N input data lines, wherein M is a non-zero, positive integer and N>M, one of M reference signals being transmitted on each of the M reference lines; and transmitting, to each of the plurality of data driver circuits, N data signals on said N data lines and M reference signals on said M reference lines; wherein at each of the plurality of data driver circuits, data values on said N data lines are determined according to differences between currents on said N data lines and currents on said M reference lines.

6. The method of claim 5, wherein at least one of the following is true: M=1; and N=2.

7. The method of claim 5, wherein said data lines are part of a flat panel display device having a display panel organized as a grid of said data lines and gate lines.

8. The method of claim 7, wherein the flat panel display device is a liquid crystal display device.

9. A data driver circuit comprising:

an input unit to receive N input data signals on N data lines and M reference signals on M reference lines, wherein N and M are non-zero, positive integers and N>M; and a determining unit to determine data values on said data lines according to differences between currents on said N data lines and currents on said M reference lines, respectively; wherein the data driver circuit drives columns or channels of a liquid crystal display (LCD) panel based on the data values determined by the determining unit.

10. The receiver of claim 9, wherein at least one of the following is true: M=1; and N=2.

11. The receiver of claim 9, wherein said data lines are part of a flat panel display device having a display panel organized as a grid of said data lines and gate lines.

12. The receiver of claim 11, wherein the flat panel display device is a liquid crystal display device.

13. A transmitter for transmitting data signals to a plurality of data driver circuits over data lines, the transmitter comprising:

a data output unit to transmit N data signals on N data lines to each of the plurality of data driver circuits, where N is a non-zero positive integer; and a reference output unit to transmit M reference signals on M reference lines to each of the plurality of data driver circuits, M being a non-zero, positive integer and N>M; wherein each of the plurality of data driver circuits determines data values on particular ones of said data lines according to differences between currents on said N data lines and currents on said M reference lines.

14. The transmitter of claim 13, wherein at least one of the following is true: M=1; and N=2.

15. The transmitter of claim 13, wherein said data lines are part of a flat panel display device having a display panel organized as a grid of said data lines and gate lines.

16. The transmitter of claim 15, wherein the flat panel display device is a liquid crystal display device.

17. A flat panel display device having a display panel organized as a grid of data lines and gate lines, the device comprising:

a plurality of data driver circuits for driving respective ones of said data lines, each data driver circuit receiving N data signals on N input data lines and M reference signals on M reference lines, wherein N and M are non-zero, positive integers and N>M; and wherein each data driver circuit is operable to determine data values on a particular one of said data lines according to a difference between current on the particular data line and current on the reference line.

18. The device of claim 17, further comprising:

a timing controller for converting received video signals into gate signals and source signals;

wherein said timing controller is operable to provide N source signals to each data driver circuit via said N input data lines, respectively.

19. The device of claim 17, wherein each data driver circuit includes a comparator for each of said N data lines, wherein each comparator has one input terminal connected to a respective input line and the other input terminal connected to one of said M references lines.

20. The device of claim 17, wherein N=2 and M=1.

21. The device of claim 17, wherein the flat panel display device is a liquid crystal display device.

22. The device of claim 17, wherein said display panel includes a transparent substrate that forms a part of an enclosure of light transmission control material; and wherein said plurality of data driver circuits are formed on said transparent substrate as a chip-on-glass type of structure.

23. The device of claim 22, wherein each input data line is a transmission line having a terminating element formed as a part of said driver circuit.

24. The device of claim 17, wherein said plurality of data driver circuits are provided on a substrate that is a discrete structure relative to said display panel.

25. The device of claim 24, wherein said substrate is a printed circuit board ("PCB") or film; and wherein said plurality of data driver circuits are formed on said PCB or film.

26. The method of claim 1, wherein values of the reference signals were set independently of values of the data signals.

27. The receiver of claim 9, wherein values of the M reference signals were set independently of values of the N input data values on said data lines.

28. The device of claim 17, wherein values of the M reference signals were set independently of the N data signals.

29. The method of claim 5, wherein:

values of the reference signals are set independently of the data.

30. The transmitter of claim 13, wherein:

values of the reference signals are set independently of the data.

* * * * *